US009185505B2

(12) United States Patent
Kristensen et al.

(10) Patent No.: US 9,185,505 B2
(45) Date of Patent: Nov. 10, 2015

(54) METHOD OF IMPROVING A LONG TERM FEEDBACK PATH ESTIMATE IN A LISTENING DEVICE

(71) Applicant: Oticon A/S, Smørum (DK)

(72) Inventors: Michael Smed Kristensen, Smørum (DK); Michael Syskind Pedersen, Smørum (DK)

(73) Assignee: OTICON A/S, Smorum (DK)

( * ) Notice: Subject to any disclaimer, the term of this patent is extended or adjusted under 35 U.S.C. 154(b) by 368 days.

(21) Appl. No.: 13/732,777

(22) Filed: Jan. 2, 2013

(65) Prior Publication Data

US 2013/0188796 A1 Jul. 25, 2013

Related U.S. Application Data

(60) Provisional application No. 61/582,505, filed on Jan. 3, 2012.

(30) Foreign Application Priority Data

Jan. 3, 2012 (EP) ..... 12150097

(51) Int. Cl.
*H04R 25/00* (2006.01)

(52) U.S. Cl.
CPC ..... *H04R 25/70* (2013.01); *H04R 25/453* (2013.01); *H04R 25/305* (2013.01); *H04R 25/554* (2013.01); *H04R 25/558* (2013.01); *H04R 2225/41* (2013.01); *H04R 2225/83* (2013.01)

(58) Field of Classification Search
None
See application file for complete search history.

(56) References Cited

U.S. PATENT DOCUMENTS

| | | | | |
|---|---|---|---|---|
| 6,219,427 | B1 * | 4/2001 | Kates et al. | 381/318 |
| 8,655,001 | B1 * | 2/2014 | Goldstein | 381/318 |
| 2010/0020996 | A1 * | 1/2010 | Elmedyb et al. | 381/318 |
| 2010/0232634 | A1 * | 9/2010 | Boldt | 381/318 |
| 2010/0329493 | A1 | 12/2010 | Arndt et al. | |
| 2011/0103613 | A1 * | 5/2011 | Van Der Werf et al. | 381/93 |

FOREIGN PATENT DOCUMENTS

| | | | |
|---|---|---|---|
| EP | 2003928 | A1 | 12/2008 |
| EP | 2148525 | A1 | 1/2010 |
| EP | 2276272 | A1 | 1/2011 |
| WO | WO 2008/151970 | A1 | 12/2008 |
| WO | WO 2010/049543 | A2 | 5/2010 |
| WO | WO 2011/420055 | A1 | 4/2011 |

* cited by examiner

*Primary Examiner* — Brenda Bernardi
(74) *Attorney, Agent, or Firm* — Birch, Stewart, Kolasch & Birch, LLP

(57) ABSTRACT

A method provides a long term feedback path estimate of a listening device. The method comprises a) providing an estimate of the current feedback path; b) providing a number of detectors of parameters or properties of the acoustic environment of the listening device and/or of a signal of the listening device, each detector providing one or more detector signals; c) providing a criterion for deciding whether an estimate of the current feedback path is reliable based on said detector signals; d) storing said estimate of the current feedback path, if said criterion IS fulfilled and neglecting said estimate of the current feedback path, if said criterion is NOT fulfilled; e) providing a long term estimate of the feedback path based on said stored estimate(s) of the current feedback path.

21 Claims, 12 Drawing Sheets
(3 of 12 Drawing Sheet(s) Filed in Color)

- Prior Art -

- Prior Art -

- Prior Art -

- Prior Art -

METHOD OF IMPROVING A LONG TERM FEEDBACK PATH ESTIMATE IN A LISTENING DEVICE

CROSS REFERENCE TO RELATED APPLICATIONS

This nonprovisional application claims the benefit under 35 U.S.C. §119(e) of U.S. Provisional Application No. 61/582,505 filed on Jan. 3, 2012 and under 35 U.S.C. §119(a) of Patent Application No. 12150097.9 filed in Europe on Jan. 3, 2012. The entire content of all of the above applications is hereby incorporated by reference.

TECHNICAL FIELD

The present application relates to leakage detection in listening devices comprising an in the ear (ITE) part adapted for being mounted fully or partially in an ear canal of a user. The present application relates in particular to providing a reliable long term estimate of the feedback path of a listening device during normal operation. The application furthermore relates to a listening device providing an alarm indication when an ITE part of the device is not properly mounted in an ear canal of the user wearing the device.

The application further relates to a data processing system comprising a processor and program code means for causing the processor to perform at least some of the steps of the method.

The disclosure may e.g. be useful in applications such as hearing aids, headsets, ear phones, active ear protection systems.

BACKGROUND

The following account of the prior art relates to one of the areas of application of the present application, hearing aids.

Acoustic feedback occurs because the output loudspeaker signal from an audio system providing amplification of a signal picked up by a microphone is partly returned to the microphone via an acoustic coupling through the air or other media. The part of the loudspeaker signal returned to the microphone is then re-amplified by the system before it is re-presented at the loudspeaker, and again returned to the microphone. As this cycle continues, the effect of acoustic feedback becomes audible as artifacts or even worse, howling, when the system becomes unstable. The problem typically appears when the microphone and the loudspeaker are placed closely together, as e.g. in hearing aids. Some other typical situations with feedback problems relate to telephony, public address systems, headsets, audio conference systems, etc.

A particular problem occurs when the coupling conditions of a hearing aid (in particular an ITE part of a hearing aid) to a user's ear canal is different from what is intended (e.g. different from what was assumed when the hearing aid was designed and/or fitted to the person in question), e.g. because the mounting of the hearing aid in the ear canal is less than optimal or because the ear canal changes over time. The latter is e.g. the case for children. Because the ears of children grow fast, it is important with a pre-warning by a leakage detector and possibly to lower the gain depending on the detected leakage.

It is known to apply a digital loop gain estimator in a DFC system (DFC=dynamic feedback cancellation), and also to realize a digital maximum gain limiter under control of the DFC. This feature is known as a fast online feedback manager. A fast and a slow online feedback managing (OFBM) system are e.g. described in WO 2008/151970 A1. Using the fast and slow OFBM parts of such a system, a long term maximum insertion gain (IGmax) can be estimated and changes to the limits for the gain in the hearing aid can accordingly be made to avoid long term problems with a hearing aid that sounds bad or is likely to howl (e.g. due to child growth). The long term IGmax is estimated by logging fast (current) IGmax estimates provided by the DFC system and filtering them to provide a slower varying long term estimate.

SUMMARY

In the present context, IGmax is taken to mean the (frequency dependent) maximum (insertion) gain value that may be applied to an input signal. IGmax is determined with a view to feedback to avoid instability. IGmax(f) values for each frequency or channel are e.g. determined from predetermined values of maximum loop gain $LG_{max}(f)$ of a loop comprising a forward path from an input transducer to an output transducer, the forward path comprising a gain element for providing a gain IG (including the insertion gain and any other gain in the forward path, e.g. possible gain in the input and output transducers), and an external feedback path from the output transducer to the input transducer providing a feedback gain FBG. In other words, LG=IG+FBG, i.e. IG=LG−FBG in a logarithmic representation, so $IGmax=LG_{max}-FBG_{max}$). Predefined maximum loop gain values $LG_{max}(f)$ are e.g. determined from an estimate of the maximum allowable loop gain before howling occurs ($LG_{howl}$) diminished by a predefined safety margin (gain margin GM, so $LG_{max}=LG_{howl}-GM$, and $IGmax=LG_{howl}-GM-FBG_{max}$). Predefined maximum gain values IGmax(f) are e.g. based on the predefined maximum loop gain values $LG_{max}(f)$ (and gain margins GM(f)) and on assumptions (or measurements) of maximum predictable feedback gain values, $FBG_{max}(f)$, (such values being dependent on the type of hearing aid, the size of a possible vent, the user's ear canal, etc.). At a given point in time, the gain $IG_{req}(f,t)$ requested by the listening device according to the user's hearing impairment, the current acoustic environment, input level, etc., will thus—if larger than IGmax—be limited to IGmax (providing a resulting gain $IG_{res}$, so $IG_{res}=MIN(IG_{req},IGmax)$.

The current IGmax values are logged at regular time instances and previously nothing was done to assure the validity of the estimates. A given estimate can be a good representation of the feedback path due to leakage, but it can also comprise other contributions e.g. due to a short term change in the acoustics (passing a wall, lying down, yawning, etc.) or due to a bias in the estimates caused by properties of the external sound entering the listening device (tonal signals, classical music, reverberation, i.e. signals with a high degree of autocorrelation (AC), a high degree of AC being e.g. taken to mean that the correlation time is longer than the delay of the forward path of the listening device). The long term IGmax values estimated by some sort of processing (e.g. averaging) of stored current IGmax values can therefore be affected by such situations, where the current IGmax does not reflect the true (undisturbed) feedback path (that only represent leakage from the output to the input transducer).

An object of the present application is to provide an improved long term feedback path or IGmax estimate in a listening device.

When a good long term IGmax estimate can be determined from a feedback estimation unit (e.g. the slow OFBM-unit described in WO 2008/151970 A1), this estimate can be used for detecting slow (real) changes in the feedback path, e.g. changes in the fit of a child's ear mould (children grow rapidly and thus need to have their ear moulds changed regularly), and a warning can be provided and/or the gain can be reduced at some time before feedback problems occur.

An assessment of the quality of the current IGmax values, in terms of how good the current IGmax values represent the true (leakage based) feedback path, can—according to the present disclosure—be provided using a number of detectors whose output contain information about the current acoustical environment or sound signal properties like e.g. autocorrelation or silence. The detector outputs can generally contain information that can be used to indicate when the adaptive algorithm in the DFC system cannot provide a reliable estimate of the true (leakage based) feedback path and thus neither forms the basis for a reliable (long term) estimate of IGmax.

Correspondingly, the term 'long term feedback path estimate' is in the present context taken to mean an estimate of the feedback path when the listening device is properly mounted in the ear (and preferably representative of leakage only). In an embodiment, the long term feedback path estimate is set equal to a current feedback path estimate. In an embodiment, the long term feedback path estimate is based on some sort of processing (e.g. averaging over time and/or according to an algorithm) of a number of instant (current) feedback path estimates subject to a classification according to their quality (reliability), focusing on estimates representing 'undisturbed' feedback situations (relating only to leakage), attempting to exclude feedback estimates originating from 'external' events NOT representing the ear mould-to-ear canal coupling (output-to-input transducer coupling, leakage), such 'external events' e.g. including putting on a hat, yawning, passing a wall, putting a hand to the ear, etc.

Objects of the application are achieved by the invention described in the accompanying claims and as described in the following.

A Method:

In an aspect, an object of the application is achieved by a method of providing a long term feedback path estimate of a listening device, the listening device comprising a forward path between an input transducer for converting an input sound to an electric input signal and an output transducer for converting an electric output signal to a stimulus perceived by the user as an output sound, the forward path comprising a signal processing unit for applying a frequency dependent gain to the electric input signal or a signal originating therefrom and for providing a processed signal, and feeding the processed signal or a signal originating therefrom to the output transducer;

an analysis path for analysing a signal of the forward path and comprising a feedback estimation unit for adaptively estimating a feedback path from the output transducer to the input transducer, the method comprising a) providing an estimate of the current feedback path;

b) providing a number ND of detectors of parameters or properties of the acoustic environment of the listening device and/or of a signal of the listening device, each detector providing one or more detector signals;

c) providing a criterion for deciding whether an estimate of the current feedback path or an equivalent maximum allowable gain IGmax used by the signal processing unit of the forward path derived therefrom is reliable based on said detector signals;

d) using said estimate of the current feedback path or IGmax, if said criterion IS fulfilled and neglecting said estimate of the current feedback path or IGmax, if said criterion is NOT fulfilled;

e) providing a long term estimate of the feedback path or IGmax based on said estimate(s) of the reliable current feedback path or IGmax.

This has the advantage of providing a more reliable long term feedback path or IGmax estimate allowing a comparison with a current feedback path or IGmax estimate, to verify a possible misfit of a mould or other ITE part of a listening device.

The term 'a signal originating therefrom' is in the present context taken to mean a second signal that is derived from a first signal (the second signal 'originates from' the first signal), e.g. in that the second signal comprises the first signal (possibly having been added to a third signal) or constitutes an amplified or attenuated or otherwise modified version of the first signal.

The term 'a detector' is in the present context taken to mean a unit that provides an output, e.g. in the form of a value of a parameter or property of a particular signal or mixture of signals (e.g. an acoustic or an electric signal) or a state of a device (e.g. the listening device in question).

In an embodiment, the current feedback path or IGmax estimates considered for contributing to the long term estimates (before being subject to qualification) are a subset of corresponding instant feedback path or IGmax estimates provided by a feedback estimation unit, the current feedback path estimates being e.g. provided by down-sampling or decimating the instant feedback path or IGmax estimates. In an embodiment, the instant feedback path or IGmax estimates are updated with a frequency larger than or equal to 20 Hz, e.g. larger than or equal to 40 Hz. In an embodiment, the instant feedback path or IGmax estimates are down-sampled to provide one current feedback path or IGmax estimate at most every 0.02 s, such as at most every 0.1 s, or at most every second or at most every minute. In an embodiment, the down-sampling provides a current feedback path or IGmax estimate at most every 100 ms or at least every minute (e.g. 0.17 Hz$\leq f_{upd} \leq$10 Hz, where $f_{upd}$ is the update frequency of the current feedback or IGmax estimate (or the effective update frequency of valid feedback path estimates after qualification of the current feedback path estimates). In an embodiment, the update frequency (or effective update frequency) is smaller than 10 Hz, e.g. smaller than 2 Hz, e.g. smaller than 0.5 Hz or smaller than 0.1 Hz or smaller than 0.05 Hz or smaller than 0.01 Hz or smaller than 0.001 Hz, or smaller than $10^{-4}$ Hz.

In an embodiment, the method comprises comparing the long term feedback path or IGmax estimate with the current feedback path or IGmax estimate, and providing a measure for their difference, termed the feedback difference measure FBDM or the IGmax difference measure IGDM, respectively.

In an embodiment, the long term estimate of the feedback path or IGmax is determined as a weighted sum, e.g. an average, e.g. a moving average (i.e. an average over a moving time window of fixed width, e.g. implemented by a FIR filter), of said (possibly stored) estimate(s) of the reliable current feedback path or IGmax. In an embodiment, the average estimates are weighted averages, e.g. where the oldest values have smaller weighting factors than the newest values (e.g. implemented by an IIR filter).

In an embodiment, the criterion for deciding whether an estimate of the current feedback path or IGmax is reliable is defined by a quality parameter. In an embodiment, the quality parameter is a binary variable whose values indicate that the estimate of the current feedback path or IGmax is considered to be reliable or NOT reliable, respectively. In an embodiment, the quality parameter is derived from a table of possible values for said parameters or properties of the acoustic environment of the listening device and/or of a signal of the listening device. In an embodiment, the quality parameter has a specific value for (some or all) combinations of said possible values for said parameters or properties of the acoustic environment of the listening device and/or of a signal of the listening device.

In an embodiment the criterion is defined by a logic combination of outputs of the detectors. In general, the output of a detector can take on any value, be analogue or digital. In an embodiment, outputs of one or more of the detectors are represented by binary variables assuming only two values, e.g. 0 and 1 or TRUE and FALSE.

In an embodiment, the criterion for deciding whether an estimate of the current feedback path or IGmax is reliable comprises a sub-criterion for each of said detectors. In an embodiment, the criterion is fulfilled, if specific combinations of said sub-criteria are fulfilled. In an embodiment, the criterion is fulfilled, if one or more, such as a majority, such as all of said sub-criteria are fulfilled.

In an embodiment, the estimate of the current feedback path or IGmax is only stored and/or used if said criterion for deciding whether an estimate of the current feedback path is reliable is fulfilled for a predetermined time $\Delta T_{crit}$ (cf. parameter 'max_count(f)' of the COUNTER(f) in the flow diagram of FIG. 7). A relatively longer 'convergence time' of the adaptive algorithm is experienced after a period of a relatively large autocorrelation of the input signal, and hence a relatively large value of $\Delta T_{crit}$ is preferable. In an embodiment, the predetermined time $\Delta T_{crit}$ is in the range from 0 s to 10 s. In an embodiment, $\Delta T_{crit}$ is in the range from 0 s to 20 s, e.g. from 5 s to 15 s. In an embodiment, the predetermined time $\Delta T_{crit}$ is adaptively determined, e.g. dependent on an adaptation rate (or step size) of the adaptive algorithm of the feedback estimation unit. The larger the step size, the smaller $\Delta T_{crit}$ is necessary (and vice versa). The closer the current feedback estimate or IGmax is to the long term feedback estimate the smaller the $\Delta T_{crit}$ is necessary (and vice versa).

In an embodiment, the values of reliable current feedback path or IGmax estimates that are used in the long term estimate of the feedback path or IGmax are controlled by the feedback or IGmax difference measure, respectively.

In an embodiment, the feedback estimation system is configured to use a long term estimate of the feedback path instead of the current (fast) feedback estimate, in case the current feedback path estimate diverges (e.g. due to substantial auto-correlation in the input signal or to substantial cross-correlation between the input and output signal of the listening device).

In an embodiment, threshold values IGmax,TH(f) of IGmax(f) are defined, the threshold values defining a warning criterion for issuing a warning and/or initiating an action, when a reliable current and/or long term IGmax(f,t) value is below said threshold value.

In an embodiment, a warning signal is generated when the warning criterion is fulfilled. In an embodiment, IGmax, which is used in the listening device to limit gain of the forward path, is reduced when the warning criterion is fulfilled.

In an embodiment, the gain available to a user via a volume control element is limited instead of or in addition to IGmax when a warning criterion is fulfilled.

In an embodiment, (possibly frequency dependent) threshold values of IGmax(f) are defined.

In an embodiment, first (possibly frequency dependent) warning threshold values IGmax,TH1(f) are defined, the first threshold values defining a first warning criterion for issuing a warning and/or initiating an action when a reliable current and/or long term IGmax(f,t) value is below said first threshold value. In an embodiment, a warning signal is generated when the first warning criterion is fulfilled (IGmax(f,t)<IGmax,TH1(f)).

In an embodiment, second (possibly frequency dependent) warning threshold values IGmax,TH2(f) are defined, the second threshold values defining a second warning criterion for issuing a warning and/or initiating an action when a reliable current and/or long term IGmax(f,t) value is below said second threshold value. In an embodiment, IGmax used in the listening device to limit gain of the forward path is reduced when the second warning criterion is fulfilled (IGmax(f,t) <IGmax,TH2(f)).

Preferably a certain amount of hysteresis is introduced to avoid fluctuations in the fulfilment of the warning criteria when the reliable current and/or long term IGmax(f,t) is close to the first or second warning threshold values. This can be achieved by defining respective further (larger) warning threshold values for disabling the first and second warnings and/or actions, when the respective first and second warning criteria are no longer fulfilled (cf. e.g. FIG. 5).

In an embodiment, a valid sample efficiency is defined as the number of reliable current feedback path or IGmax estimates $N_{vs}$ relative to the total number of current feedback path or IGmax estimates $N_s$ (over a given time period $\Delta t$), $N_{vs}/N_s$. The sample rate $f_s$ is defined as the number of samples $N_s$ per time unit, $N_s/\Delta t$ (where $N_s$ is the number of samples in time interval $\Delta t$). Correspondingly, an effective sample rate $f_{s,eff}$ may be defined as the number of valid samples per time unit, $N_{vs}/\Delta t$ (where $N_{vs}$ is the number of valid samples in time interval $\Delta t$).

In an embodiment, the long term estimate of the feedback path or IGmax is determined by an update algorithm comprising a time constant $t_c$ that determines the maximum rate of change (adaptation rate) of the long term estimate.

In an embodiment, the time constant $t_c$, together with the sample rate $f_s$, determine the step size $\mu$ needed to get a particular rate of change of the long term estimate, and wherein the time constant $t_c$ is adapted to be proportional to the rate of change of the leakage.

In an embodiment, the long term estimate of the feedback path or IGmax, e.g. termed FBGmax,slow (FBGmax,LT) and IGmax,slow (or IGmax,LT), respectively, are determined from the reliable current estimates, e.g. FBGmax (or FBGmax,CUR) and IGmax (or IGmax,CUR), respectively, by the algorithm $$FBG\text{max,slow}(t,f)=\alpha\cdot FBG\text{max}(t,f)+(1-\alpha)\cdot FBG\text{max,slow}(t-1,f), \text{ or}$$

$$IG\text{max,slow}(t,f)=\alpha\cdot IG\text{max}(t,f)+(1-\alpha)\cdot IG\text{max,slow}(t-1,f),$$

where $\alpha$ is a parameter between 0 and 1, t is time and f is frequency and 't−1' indicates the previous time instance, for which a reliable value of FBGmax,slow and IGmax,slow, respectively, is available. The parameters t for time and f for frequency are typically digital indices (replaceable by n and k, respectively). The parameter $\alpha$ determines the rate of change (adaptation rate) of the long term estimate. In an embodiment, the parameter $\alpha$ is adaptively determined allowing e.g. the use of a faster adaptation rate when needed. When $\alpha$ is relatively small ($\alpha_{slow}$, e.g. close to 0), the previous values of the long term estimates are dominant over new current estimates (providing a relatively slow adaptation to current changes of the feedback path). When $\alpha$ is relatively large ($\alpha_{fast}$, e.g. close to 1), the values of the current estimates are dominant over previous long term estimates (providing a relatively fast adaptation to current changes of the feedback path).

In an embodiment, the long term estimate, e.g. IGmax, slow, is determined by the algorithm $$IG\max,\text{slow}(t,f)=IG\max,\text{slow}(t-1,f)+/-\mu,$$

where $\mu$ is a step size of the algorithm and where '+' is selected, if the current value is larger than the previous value and where '−' is selected, if the current value is smaller than the previous value. In an embodiment, the parameter $\mu$ is adaptively determined allowing e.g. the use of a faster adaptation rate when needed. A corresponding algorithm for determining FBGmax,slow can be used.

In case it is detected (or assumed) that the feedback situation has changed substantially (and permanently), e.g. in case that a new and better fitting ear mould has been taken into use, or e.g. in case that the ear canal has grown since the last use of the listening device resulting in a less well fitting ear mould, it is preferable that the long term feedback or IGmax estimate is adapted to the new situation over a relatively short time period (cf. FIG. 5).

This can be achieved manually (e.g. by an audiologist) or automatically. In an embodiment, the initiation of a faster adaptation rate of the long term feedback path or IGmax estimate is provided via a user interface or a programming interface. Further, the time window over which the reliable current feedback path or IGmax estimates are averaged to provide the long term feedback path or IGmax estimate may be decreased to include fewer 'older' values of current feedback in the calculation. In an embodiment, the current feedback path estimate is used to detect whether the ear mould has been replaced, and to subsequently update the long term feedback path estimate. Alternatively or additionally, weights on the more recent values of current feedback path estimates may be increased (and weights on relatively older estimates decreased) in the averaging process (cf. e.g. adaptation rate parameter $\alpha$ in the first exemplary update algorithm for IGmax,slow(t,f) (or FBGmax,slow) mentioned above). Similarly, the step size $\mu$ in the second update algorithm for IGmax,slow(t,f) (or FBGmax,slow) mentioned above may be increased. Such measures correspond to decreasing the long term IGmax update time constant (increasing adaptation rate).

In an embodiment, the long term estimate of the feedback path or IGmax is determined by an update algorithm comprising a time constant $t_c$ that determines the maximum rate of change of the long term estimate. The time constant determines, together with the sample rate $f_s$, the step size $\mu$ needed to get a particular rate of change of the long term estimate. The time constant is preferably adapted to be proportional to the rate of change of the leakage, e.g. in units of dB/day. If for example 100 valid estimates of current IGmax are obtained within 4 hours, and if the leakage increases by 0.25 dB within this period, the time constant should be chosen so that the long term IGmax can decrease with 0.25 dB within the same period. In this case, the step size $\mu$ of the update algorithm should be at least 0.25/100=0.0025. In an embodiment, the step size is at least 0.01, such as at least 0.05, such as at least 0.1. In an embodiment, the step size is in the range between 0.0025 and 0.1, e.g. assuming a low value ($\mu_{slow}$) and a high value ($\mu_{high}$) in that range depending on the situation.

In an embodiment, an adaptation rate of the long term IGmax estimate is relatively low (e.g. $\alpha_{slow}$ or $\mu_{slow}$), when the numerical difference between the current (fast) and the long term feedback estimates is below a predetermined threshold value $X_{TH}$ (e.g. $|IGDM(f)|<X_{TH}$) indicating that the acoustic environment of the listening device is stable. Hence an IGmax difference measure (IGDM) or a feedback difference measure (FBDM) can be used as an alternative (or supplement) to an environment detector.

To implement the update algorithm as an IIR filter, the time constant $t_c$ is converted to an IIR filter coefficient as $1-\exp(-1/(f_{s,eff}*t_c))$, where $t_c$ is the time constant in s, exp is the exponential function and $f_{s,eff}$ the effective sample rate in Hz.

A Listening Device:

In an aspect, a listening device comprising a forward path between an input transducer for converting an input sound to an electric input signal and an output transducer for converting an electric output signal to a stimulus perceived by the user as an output sound, the forward path comprising a signal processing unit for applying a frequency dependent gain to the electric input signal or a signal originating therefrom and for providing a processed signal, and feeding the processed signal or a signal originating therefrom to the output transducer;

an analysis path for analysing a signal of the forward path and comprising a feedback estimation unit for adaptively estimating a feedback path from the output transducer to the input transducer is furthermore provided by the present application. The listening device comprises a) a fast feedback estimation unit for providing an estimate of the current feedback path;

b) a number ND of detectors of parameters or properties of the acoustic environment of the listening device and/or of a signal of the listening device, each detector providing one or more detector signals;

c) a control unit for deciding whether an estimate of the current feedback path or an equivalent maximum allowable gain IGmax applied by the signal processing unit of the forward path derived therefrom is reliable based on said detector signals and a predefined criterion;

d) a calculation unit for providing a long term estimate of the feedback path or IGmax based on said estimate(s) of the reliable current feedback path or IGmax.

It is intended that the processing features of the method described above, in the 'detailed description of embodiments' and in the claims can be combined with the device, when appropriately substituted by a corresponding structural feature and vice versa. Embodiments of the devices have the same advantages as the corresponding methods.

Every time a "current feedback path or IGmax" estimate is available, it is decided whether the current estimate can be used to update the long term feedback path or IGmax estimates or not (i.e. whether or not the current estimate is reliable). If it can, it will be used in the update of long term values. In an embodiment, the listening device comprises a memory for storing said estimate of the current feedback path or IGmax, if said criterion IS fulfilled and neglecting said estimate of the current feedback path or IGmax, if said criterion is NOT fulfilled. In a preferred embodiment, an update algorithm is used to determine long term estimates. In an embodiment, it is only necessary to store the immediately preceding value of the current feedback path or IGmax estimate (or to use an accumulator that immediately calculates the new long term estimate from the (valid) current estimate).

In an embodiment, values of reliable feedback estimates are stored over time. In an embodiment, statistical data relating to reliable and unreliable current feedback estimates are stored over time. In an embodiment, statistical data relating to long term feedback estimates are stored over time. Such data can be analyzed to indicate a pattern of use of the listening device, e.g. by transfer to a fitting software (or by a signal processing unit of the listening device itself).

In an embodiment, the calculation unit is adapted to determine a difference measure (FBDM or IGDM) indicative of the difference between the long term estimate of the feedback path or IGmax and the estimate of the reliable current feedback path or IGmax, respectively.

In an embodiment, a number of consecutive reliable current feedback path or IGmax estimates are stored in the memory. In an embodiment, the long term estimate of the feedback path or IGmax is determined as an average, e.g. a moving average (i.e. an average over a moving time window of fixed width, e.g. implemented by an FIR filter), of said stored estimate(s) of the reliable current feedback path or IGmax. In an embodiment, the average estimates are weighted averages, e.g. where the oldest values have smaller weighting factors than the newest values (e.g. implemented by a $1^{st}$ order IIR filter). Alternatively or additionally, the calculation unit is adapted to execute an algorithm for updating the long term estimates (e.g. IGmax,slow(f,t)) based on the current estimate (e.g. IGmax(f,t)) and previous long term estimate (e.g. IGmax,slow(f,t−1)) of the feedback path or IGmax.

In an embodiment, the listening device is adapted to transfer a number of consecutive reliable current feedback path or IGmax estimates and/or long term feedback or IGmax estimates determined in the listening device to another device for storage and analysis, e.g. to a programming device running a fitting program for programming (fitting) the listening device.

In an embodiment, the listening device comprises an alarm indication unit adapted for issuing an alarm signal based on said difference measure (FBDM or IGDM). A listening device comprising such alarm indication unit is disclosed in our co-pending European patent application EP12150093.8 entitled A listening device and a method of monitoring the fitting of an ear mould of a listening device and filed on 3 Jan. 2012, and which is hereby incorporated by reference.

In an embodiment, threshold values IGmax,TH(f) of IGmax(f) are defined in the listening device (e.g. in the control unit or in the signal processing unit), the threshold values defining a warning criterion for issuing a warning and/or initiating an action, when a reliable current or long term IGmax(f,t) value fulfils the criterion (e.g. is/are below said threshold value(s)). The warning criterion (or criteria) may alternatively be based on feedback path estimate values FBGmax(f).

In an embodiment, the listening device is adapted to generate a warning signal when said warning criterion is fulfilled. In an embodiment, such warning signal is sent to the alarm indication unit and issued as an alarm to the user (or a person caring for the user).

In an embodiment, the signal processing unit is adapted to reduce IGmax used in the listening device to limit gain of the forward path when said warning criterion is fulfilled. In an embodiment, a warning is simultaneously generated and issued via the alarm indication unit (and/or transmitted to another device).

In an embodiment, the listening device is adapted to provide a frequency dependent gain to compensate for a hearing loss of a user. In an embodiment, the signal processing unit is adapted for enhancing the input signals and providing a processed output signal. Various aspects of digital hearing aids are described in [Schaub; 2008].

In an embodiment, the listening device comprises a directional microphone system adapted to enhance a target acoustic source among a multitude of acoustic sources in the local environment of the user wearing the listening device. In an embodiment, the directional system is adapted to detect (such as adaptively detect) from which direction a particular part of the microphone signal originates. This can be achieved in various different ways as e.g. known from the prior art.

In an embodiment, the listening device comprises an antenna and transceiver circuitry for wirelessly receiving a direct electric input signal (e.g. comprising audio, control or other information) from another device, e.g. a communication device or another listening device.

In an embodiment, the listening device is or comprises a portable device, e.g. a device comprising a local energy source, e.g. a battery, e.g. a rechargeable battery. In an embodiment, the listening device has a maximum outer dimension of the order of 0.1 m (e.g. a head set). In an embodiment, the listening device has a maximum outer dimension of the order of 0.04 m (e.g. a hearing instrument).

In an embodiment, the analysis path comprises functional components for analyzing the input signal (e.g. determining a level, a modulation, a correlation, a type of signal, an acoustic feedback estimate, etc.). In an embodiment, the listening device comprises a common feedback estimation system for all microphones of the input transducer of the listening device. In an embodiment, the listening device comprises a feedback estimation system for each microphone of the input transducer of the listening device. In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 40 kHz (adapted to the particular needs of the application) to provide digital samples $x_n$ (or x[n]) at discrete points in time $t_n$ (or n), each audio sample representing the value of the acoustic signal at $t_n$ by a predefined number $N_s$ of bits, $N_s$ being e.g. in the range from 1 to 16 bits. A digital sample x has a length in time of $1/f_s$, e.g. 50 μs, for $f_s$=20 kHz. In an embodiment, a number of audio samples are arranged in a time frame. In an embodiment, a time frame comprises 64 audio data samples. Other frame lengths may be used depending on the practical application.

In an embodiment, the listening devices comprise an analogue-to-digital (AD) converter to digitize an analogue input with a predefined sampling rate, e.g. 20 kHz. In an embodiment, the listening devices comprise a digital-to-analogue (DA) converter to convert a digital signal to an analogue output signal, e.g. for being presented to a user via an output transducer.

In an embodiment, the listening device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the listening device from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, a signal of the forward and/or analysis path of the listening device is split into a number NI of frequency bands, where NI is e.g. larger than 5, such as larger than 10, such as larger than 50, such as larger than 100, such as larger than 500, at least some of which are processed individually. In an embodiment, the listening device is/are adapted to process a signal of the forward and/or analysis path in a number NP of different frequency channels (NP≤NI). The frequency channels may be uniform or non-uniform in width (e.g. increasing in width with frequency), overlapping or non-overlapping (cf. e.g. FIG. 3*b*).

The listening device comprises a number ND of detectors each providing one or more detector signals, which are used to decide whether a predefined criterion is fulfilled to judge whether a current feedback or IGmax estimate is reliable. In an embodiment, ND is larger than or equal to 2, such as larger than or equal to 3, larger than or equal to 4. In an embodiment, ND is smaller than or equal to 10, such as smaller than or equal to 8, such as smaller than or equal to 6.

In an embodiment, the listening device comprises one or more detectors for classifying an acoustic environment around the listening device and/or for characterizing the signal of the forward path of the listening device.

Examples of such detectors are a level detector, a speech detector, a tone or howl detector, an autocorrelation detector, a silence detector, a feedback change detector, a directionality detector, a compression sensor, etc. In an embodiment, one or more of such detectors are used in the determination of the current and/or long term feedback path estimate(s). An autocorrelation estimator is e.g. described in US 2009/028367 A1. A howl detector is e.g. described in EP 1 718 110 A1.

In an embodiment, the listening device comprises a level detector (LD) for determining the level of an input signal (e.g. on a band level and/or of the full (wide band) signal). The input level of the electric microphone signal picked up from the user's acoustic environment is e.g. a classifier of the environment. In an embodiment, the level detector is adapted to classify a current acoustic environment of the user according to a number of different (e.g. average) signal levels, e.g. as a HIGH-LEVEL or LOW-LEVEL environment. Level detection in hearing aids is e.g. described in WO 03/081947 A1 or U.S. Pat. No. 5,144,675.

In a particular embodiment, the listening device comprises a voice or speech detector (VD) for determining whether or not an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise). In an embodiment, the voice detector is adapted to detect as a VOICE also the user's own voice. Alternatively, the voice detector is adapted to exclude a user's own voice from the detection of a VOICE. A speech detector is e.g. described in WO 91/03042 A1.

In an embodiment, the listening device comprises an own voice detector for detecting whether a given input sound (e.g. a voice) originates from the voice of the user of the system. Own voice detection is e.g. dealt with in US 2007/009122 and in WO 2004/077090. In an embodiment, the microphone system of the listening device is adapted to be able to differentiate between a user's own voice and another person's voice and possibly from NON-voice sounds.

In an embodiment, the listening device comprises a music detector (e.g. based on pitch detection).

In an embodiment, the number ND of detectors at least comprises a tone detector. In an embodiment, the number ND of detectors at least comprises a howl detector. In an embodiment, the number ND of detectors at least comprises a correlation detector. In an embodiment, the correlation detector comprises an autocorrelation detector for determining or estimating the autocorrelation of the (electric) input signal. In an embodiment, the correlation detector comprises a cross-correlation detector for determining or estimating the cross-correlation between the (electric) input signal and the (electric) output signal.

In an embodiment, the listening device comprises an acoustic (and/or mechanical) feedback suppression system. Adaptive feedback cancellation has the ability to track feedback path changes over time. It is typically based on a linear time invariant filter to estimate the feedback path but its filter weights are updated over time [Engebretson, 1993]. The filter update may be calculated using stochastic gradient algorithms, including some form of the popular Least Mean Square (LMS) or the Normalized LMS (NLMS) algorithms. They both have the property to minimize the error signal in the mean square sense with the NLMS additionally normalizing the filter update with respect to the squared Euclidean norm of some reference signal. Other adaptive algorithms may be used, e.g. RLS (Recursive Least Squares). Various aspects of adaptive filters are e.g. described in [Haykin].

In an embodiment, the listening device further comprises other relevant functionality for the application in question, e.g. compression, noise reduction, etc.

In an embodiment, the listening device comprises a user interface, e.g. an activation element (e.g. a button or selection wheel) in/on the listening device or in/on a remote control, that allows a user to influence the operation of the listening device and/or otherwise provide a user input, e.g. adapted for allowing a user to initiate that a probe signal is applied (e.g. in a particular mode of operation of the listening device) to the output signal (or is played alone) or to indicate that a mould has been modified, etc. In an embodiment, the user interface comprises an activation element that allows a user to influence the operation of the listening device and/or otherwise provide a user input without using a button. In an embodiment, the activation element comprises a movement sensor, e.g. an acceleration sensor. In an embodiment, a user input can be provided by moving the listening device in a predefined manner, e.g. fast movement, e.g. from a first position to a second position and back to the first position. In an embodiment, a number of different user inputs are defined by a number of different movement patterns. In an embodiment, the user inputs comprises information relating to the fitting of the mould, e.g. about a change of the mould, e.g. to a mould with an improved fitting.

In an embodiment, the output transducer for converting the electric output signal to a stimulus perceived by the user as an output sound comprises a vibrator of a bone conducting hearing aid device. In an embodiment, the output transducer comprises a receiver (loudspeaker) for providing the stimulus as an acoustic signal to the user.

In an embodiment, the listening device comprises a hearing aid, e.g. a hearing instrument, e.g. a hearing instrument adapted for being located at the ear or fully or partially in the ear canal of a user, e.g. a headset, an earphone, an ear protection device or a combination thereof.

Use:

In an aspect, use of a listening device as described above, in the 'detailed description of embodiments' and in the claims, is moreover provided. In an embodiment, use is provided in a system comprising audio distribution, e.g. a system comprising a microphone and an output transducer (e.g. a loudspeaker or a mechanical vibrator) in sufficiently close proximity of each other to cause feedback from the output transducer to the microphone during operation by a user. In an embodiment, use is provided in a system comprising one or more hearing instruments, headsets, ear phones, active ear protection systems, etc., e.g. used in handsfree telephone systems, teleconferencing systems, public address systems, karaoke systems, classroom amplification systems, etc.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application. In addition to being stored on a tangible medium such as diskettes, CD-ROM-, DVD-, or hard disk media, or any other machine readable medium, and used when read directly from such tangible media, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Listening System:

In a further aspect, a listening system comprising a listening device as described above, in the 'detailed description of embodiments', and in the claims, AND an auxiliary device is moreover provided.

In an embodiment, the system is adapted to establish a communication link between the listening device and the auxiliary device to provide that information (e.g. control and status signals (e.g. including information about an estimated feedback path, e.g. a current feedback estimate, e.g. a feedback difference measure), possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the listening device. In an embodiment, the auxiliary device is or comprises a remote control for controlling functionality and operation of the listening device(s).

In an embodiment, the auxiliary device is another listening device. In an embodiment, the listening system comprises two listening devices adapted to implement a binaural listening system, e.g. a binaural hearing aid system.

Further objects of the application are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The patent or application file contains at least one color drawing. Copies of this patent or patent application publication with color drawing will be provided by the USPTO upon request and payment of the necessary fee.

The disclosure will be explained more fully below in connection with a preferred embodiment and with reference to the drawings in which.

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

Acoustic feedback occurs because the output loudspeaker signal from an audio system providing amplification of a signal picked up by a microphone is partly returned to the microphone via an acoustic coupling through the air or other media. A particular problem occurs in listening devices to children, because the ears of children grow fast and thus coupling conditions (leakage) changes over time.

Figure 1A:
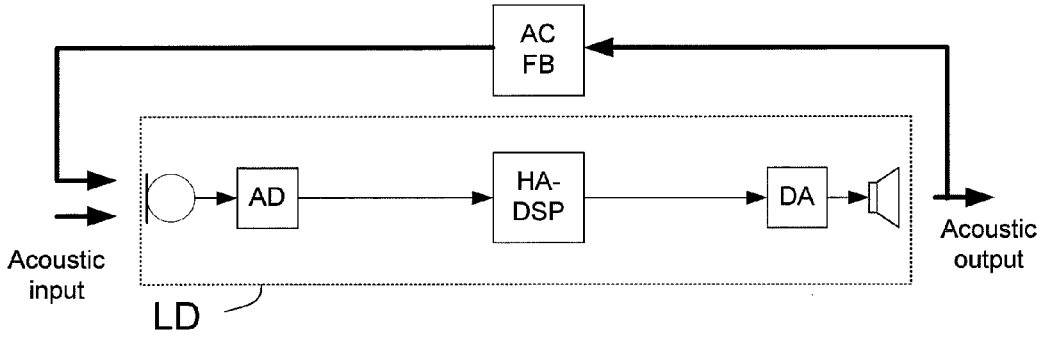
FIG. 1 shows four embodiments of prior art listening devices (FIG. 1*a*, 1*b*, 1*c*, 1*d*), and an embodiment of a listening device (FIG. 1*e*) and a binaural listening system (FIG. 1*f*) according to the present disclosure.

FIG. 1*a*-1*d* show four embodiments of a prior art listening device (LD), where an external (acoustic) feedback path (AC FB) is indicated in each embodiment. FIG. 1*a* shows a simple listening device, e.g. a hearing aid, comprising a forward (or signal) path from an input transducer (microphone) to an output transducer (loudspeaker), the forward path being defined there between and comprising analogue-to-digital (AD) and digital-to-analogue (DA) converters, and a processing unit (HA-DSP) there between for applying a (time and) frequency dependent gain to the signal picked up by the microphone and providing an enhanced signal to the loudspeaker. An analysis filter bank may be inserted in the forward path (e.g. after or in connection with the AD-converter) to provide signals in the time-frequency domain, each signal being represented by time dependent values in a number of frequency bands. A synthesis filter bank (S-FB) may in such case correspondingly be inserted in the forward path, e.g. after the signal processing unit (HA-DSP) to provide the output signal to the loudspeaker in the time domain. Processing in the frequency domain may be applied in (other) selected parts of the listening device depending on the application (algorithm) in question, e.g. in an analysis path, e.g. fully or partially comprising a feedback cancellation system (cf. FIG. 3*a*).

Figure 1B:
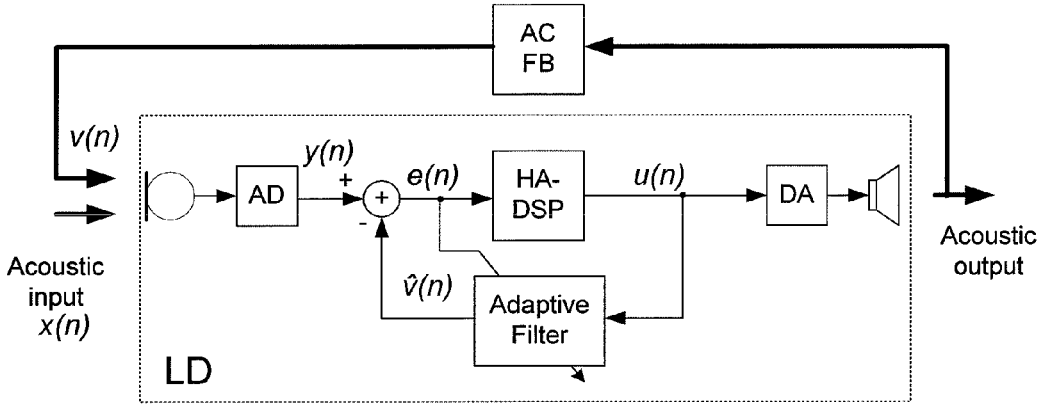
Figure 1C:
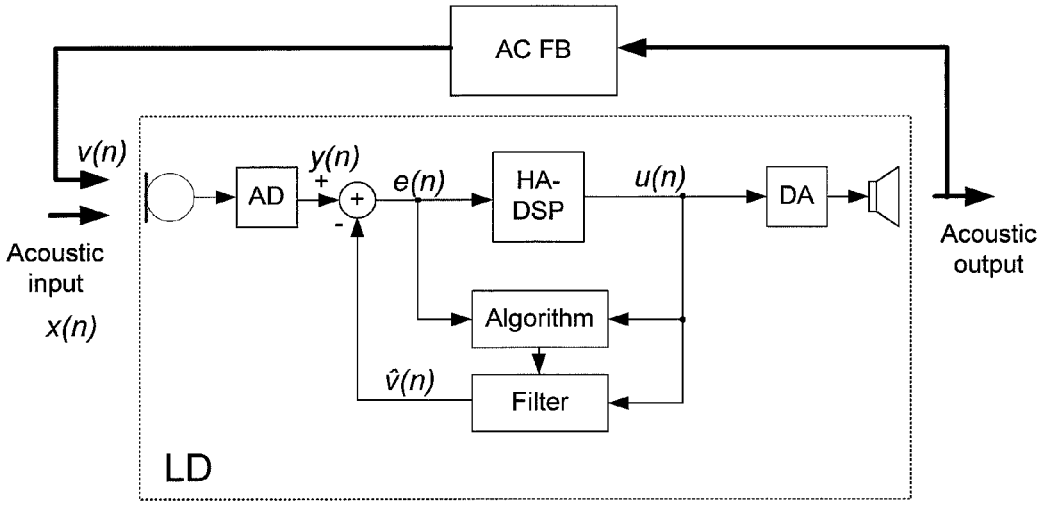
Figure 1D:
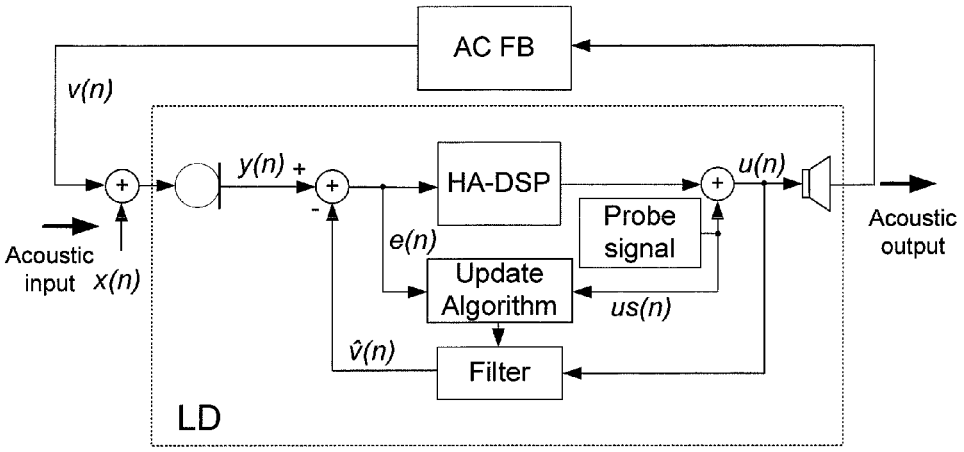

The embodiments shown in FIGS. 1*b*, 1*c* and 1*d* each comprise the same basic elements as discussed for the embodiment of FIG. 1*a* and additionally a feedback cancellation system. Feedback cancellation systems (for reducing or cancelling acoustic feedback from the 'external' feedback path (AC FB) of listening devices (e.g. hearing aids) may comprise an adaptive filter (Adaptive filter in FIG. 1*b*, Algorithm and Filter in FIG. 1*c*, 1*d*), which is controlled by a prediction error algorithm, e.g. an LMS (Least Means Squared) algorithm, in order to predict ($\hat{v}(n)$) and cancel the part (v(n)) of the microphone signal (y(n)) that is caused by feedback (from the loudspeaker to the microphone of the listening device). FIGS. 1*b*, 1*c* and 1*d* illustrate examples of this. The adaptive filter (in FIGS. 1*c* and 1*d* comprising a variable Filter part and a prediction error or Algorithm part) is (here) aimed at providing a good estimate of the 'external' feedback path from the input to the digital-to-analogue (DA) converter to the output of the analogue-to-digital (AD) converter. The prediction error algorithm uses a reference signal (e.g. the output signal u(n) in FIGS. 1*b* and 1*c* or a probe signal us(n) in FIG. 1*d* (or a mixture thereof)) together with a signal e(n) originating from the microphone signal y(n) to find the setting of the adaptive filter that minimizes the prediction error, when the reference signal is applied to the adaptive filter. The microphone signal y(n) is a mixture of a target signal (Acoustic input, x(n)) and a feedback signal (v(n)). The forward path of the listening devices (LD) of FIGS. 1*b*, 1*c* and 1*d* also comprises a signal processing unit (HA-DSP), which e.g. is adapted to adjust the signal to the impaired hearing of a user (by applying a time and frequency dependent gain to the input signal, which intends to compensate the user's hearing impairment). The estimate $\hat{v}(n)$ of the feedback path v(n) provided by the adaptive filter is (in FIGS. 1*b*, 1*c* and 1*d*) subtracted from the microphone signal y(n) in sum unit '+' providing a so-called 'error signal' e(n) (or feedback-corrected signal), which is fed to the processing unit HA-DSP and to the algorithm part of the adaptive filter. To provide an improved decorrelation between the output (u(n)) and input (y(n)) signals, it may be desirable to add a probe signal to the output signal. This probe signal us(n) can be used as the reference signal to the algorithm part (Algorithm) of the adaptive filter, as shown in FIG. 1*d* (output us(n) of block Probe signal in FIG. 1*d*), and/or it may be mixed with the ordinary output of the signal processing unit to form the reference signal. A probe signal generator is e.g. described in WO 2009/007245 A1. An appropriate probe signal comprising a selected number of tones for use in estimating a feedback path for use in a method and listening device according to the present disclosure is e.g. disclosed in our co-pending European patent application EP12150093.8 entitled A listening device and a method of monitoring the fitting of an ear mould of a listening device and filed on 3 Jan. 2012, and which is hereby incorporated by reference.

Figure 1E:
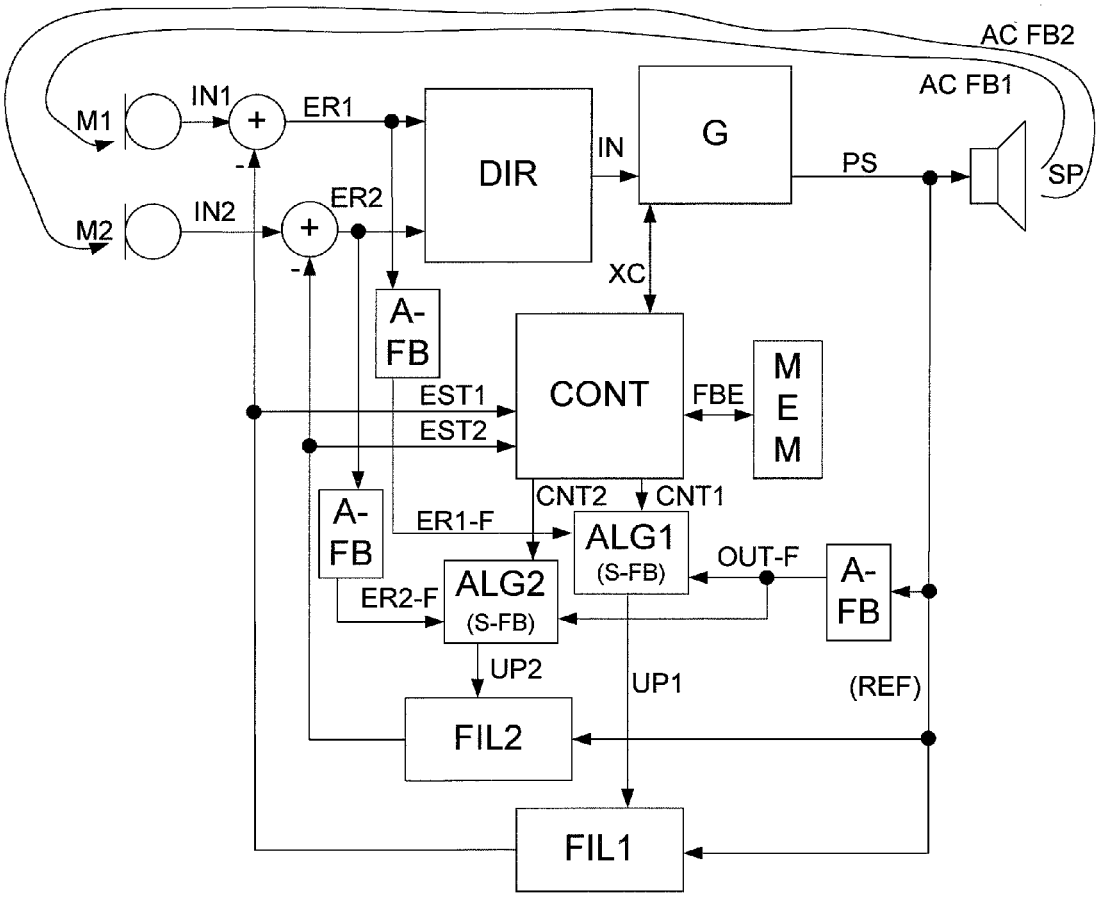

FIG. 1*e* shows an embodiment of a listening device according to the present disclosure. The input transducer of the listening device comprises two microphones (M1, M2), each microphone having a separate feedback path (AC FB1 and AC FB2, respectively) from the output transducer (speaker SP) of the listening system. Hence, each feedback path is separately estimated by the feedback estimation unit. Alternatively, only the resulting signal, after a directional algorithm has been applied to the microphone signals, is feedback compensated. The feedback estimation unit comprises two adaptive filters (ALG1, FIL1 and ALG2, FIL2, respectively) each for estimating their respective feedback path AC FB1 and AC FB2. The respective feedback path estimates EST1, EST2 are subtracted from the corresponding input signals IN1, IN2 in respective summation units ('+') to provide corresponding feedback corrected (error) signals ER1, ER2, which are fed to the DIR unit comprising a directional algorithm providing a resulting directional (or omni-directional) signal IN to the gain block G. Alternatively or additionally, the gain provided by gain block G may be influenced or determined by both microphone signals (ER1, ER2) (or (IN1, IN2), in case feedback compensation is performed after the application of the directional algorithm). The error signals ER1, ER2 are additionally fed to algorithm parts ALG1, ALG2 for determining the filter coefficients for the adaptive filters that minimize the prediction error of signals ER1, ER2, respectively, when the reference signal (output signal PS) is applied to the respective variable filter parts (FIL1, FIL2) of the adaptive filters. In the present embodiment of a listening device, the determination of update filter coefficients (signals UP1, UP2) in the algorithm parts ALG1, ALG2 is performed in the frequency domain. Hence, analysis filter banks A-FB are inserted in the error and reference (REF) signal input paths to convert time domain error signals ER1, ER2 and output signal OUT to the frequency domain (providing signals ER1-F, ER2-F and OUT-F), and corresponding synthesis filter banks (indicated by '(S-FB)') form part of the algorithm parts ALG1, ALG2 to provide the update filter coefficients UP1, UP2 to the variable filter parts FIL1, FIL2 in the time domain. This has the advantage of minimizing delay in the feedback estimation. The listening device further comprises a control unit CONT for analysing the current feedback path estimates EST1, EST2 of the feedback paths AC FB1 and AC FB2, respectively, for determining a feedback difference measure (FBDM) (and/or an IGmax difference measure IGDM) from the current (or instant) feedback path estimates EST1, EST2 and a long term feedback path estimate (or corresponding IGmax estimates) stored in memory MEM. In an embodiment, the control unit CONT is adapted for comparing the feedback estimates from the first and second feedback estimation units. In general, an average of the two feedback path estimates is used to define the current feedback path estimate, which is used to determine the long term feedback path estimate (if it fulfils a 'stability' criterion). If, however, the difference between the feedback estimates of the two feedback paths is larger than a predefined threshold value, the current feedback estimate(s) is/are not considered reliable and will not be stored as a reliable value of the current feedback estimate. The control unit CONT may further be adapted to control the two adaptive filters (e.g. a step size of their adaptation algorithms), cf. control signals CNT1 and CNT2 to algorithm parts ALG1, ALG2. The control unit CONT is further in communication with the signal processing unit G via signal XC to possibly update the values of IGmax used to determine (possibly limit) an appropriate gain for a user of the listening device. The IGmax values may be extracted from the current and/or long term feedback path (or IGmax) estimates stored in the memory MEM, which are accessible to the control unit CONT via signal FBE. The processed output signal PS from the gain block G is fed to output transducer SP and to variable filter parts FIL1, FIL2 of the two adaptive filters and to the analysis filter bank (AFB) of the feedback estimation unit. In the embodiment of FIG. 1*e*, the forward path is indicated to be mainly operated in the time domain. It may alternatively be operated in the frequency domain. Further, the feedback cancellation path is shown to be operated partly in the frequency domain (calculation of update filter coefficients) and partly in the time domain (filtering). It may alternatively be operated fully in the frequency domain (or fully in the time domain).

Figure 1F:
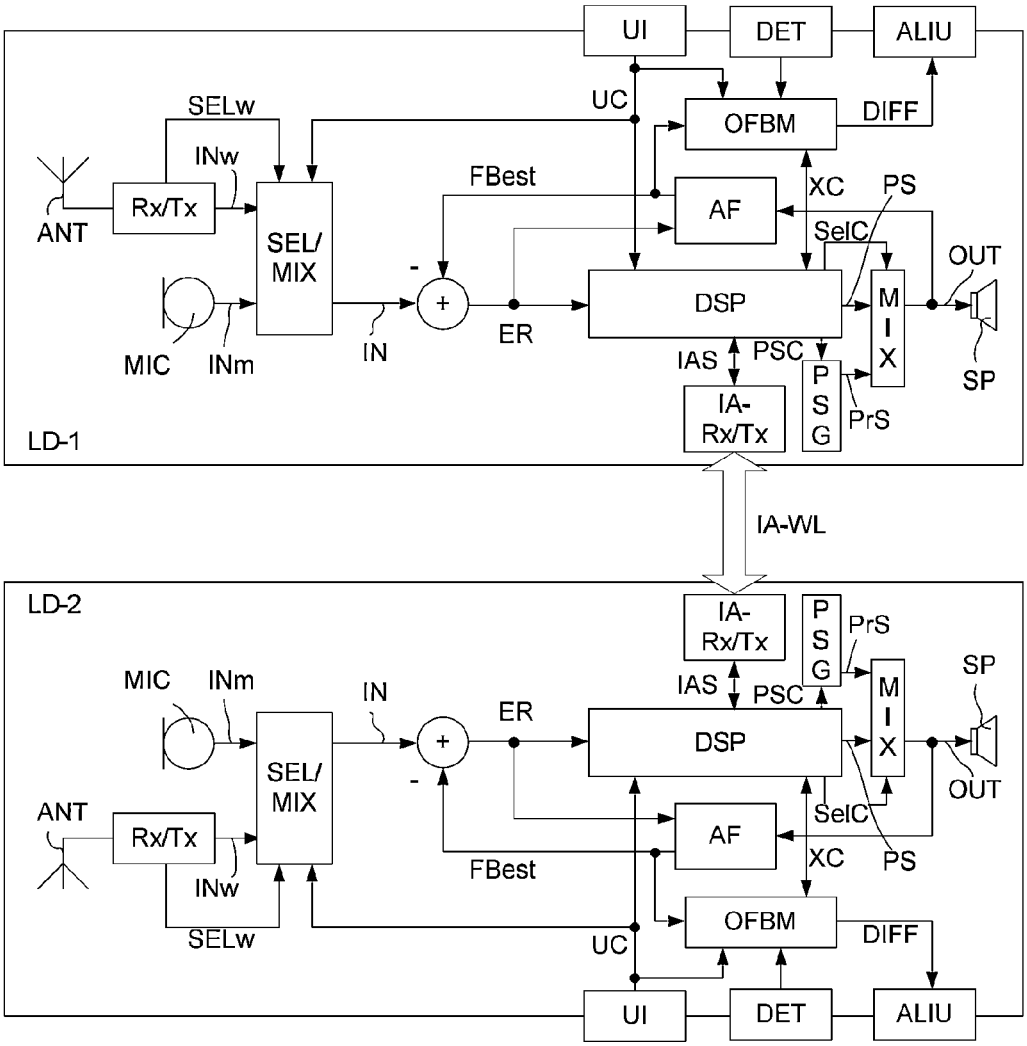

FIG. 1*f* shows an embodiment of a binaural listening system (e.g. a binaural hearing aid system) according to the present disclosure. The binaural hearing aid system comprises first and second hearing listening devices (LD-1, LD-2, e.g. hearing instruments) adapted for being located at or in left and right ears of a user. The listening devices are adapted for exchanging information between them via a wireless communication link, e.g. a specific inter-aural (IA) wireless link (IA-WL). Each listening device comprises a forward signal path comprising an input transducer (here a microphone (MIC) and/or a wireless receiver (ANT, Rx/Tx) and a selector/mixer unit (SEL/MIX)), a signal processing unit (DSP) and a speaker (SP). Each listening device further comprises a feedback cancellation system comprising a feedback cancellation unit comprising adaptive filter (AF) and combination unit ('+') for subtracting the estimate of the feedback path FBest provided by the adaptive filter (AF) from the input signal IN from the input transducer (here output of selector/mixer unit (SEL/MIX)) and thereby providing feedback corrected (error) signal ER, as described in connection with FIG. 1*b*-1*e*. Each listening device further comprises an online feedback manager (OFBM) for determining a feedback difference measure FBDM (and/or an IGmax difference measure IGDM) indicative of the difference between the currently estimated feedback path and a typical (stable, long term) feedback path (or corresponding IGmax estimates). The long term feedback path (or IGmax) estimate is determined by the online feedback manager unit (OFBM) based on reliable current feedback path (or IGmax) estimates. The current feedback path (or IGmax) estimates are qualified in the OFBM unit from instant feedback path (or IGmax) estimates $FB_{est}$ from the feedback estimation unit (AF) by a criterion involving inputs from a number of detectors (DET). The two listening device (LD-1, LD-2) are adapted to allow the exchange of status signals, e.g. including the transmission of a feedback difference measure FBDM (and/or an IGmax difference measure IGDM) determined by a listening device at a particular ear to the device at the other ear (via signal IAS). To establish the inter-aural link, each listening device comprises antenna and transceiver circuitry (here indicated by block IA-Rx/Tx). In the binaural hearing aid system of FIG. 1*f*, a signal IAS comprising feedback difference measure FBDM (or IGDM) generated by the online feedback manager (OFBM) and—via signal XC—exchanged with the signal processing unit (DSP) of one of the listening devices (e.g. LD-1) is transmitted to the other listening device (e.g. LD-2) and/or vice versa. The feedback (or IGmax) difference measure FBDM (or IGDM) from the local and the opposite device are compared and in some cases used together to decide whether an ear mould of the device in question is correctly mounted or whether a substantial change to fitting of the ear mould has occurred (be it 1) a decreased fitting, possibly indicating incorrect mounting and/or growth of the ear channel or 2) an improved fitting, possibly indicating that a new ear mould (with improved fitting) has been taken into use). The interaural signals IAS may further comprise information that enhances system quality to a user, e.g. improve signal processing, and/or values of detectors (DET) that may be of use in the other listening device. The interaural signals IAS may e.g. comprise directional information or information relating to a classification of the current acoustic environment of the user wearing the listening devices, etc. In an embodiment, detector values (e.g. autocorrelation) from both listening devices are compared in a given listening device. In an embodiment, a value of a given detector is only used in the criterion for reliability of the feedback path estimate, if the two detector values from the left and right listening devices deviate less than a predefined absolute or relative amount. Each of the listening devices further comprises an alarm indication unit (ALIU) for indicating a status of the current degree of fitting of the ear mould based on the feedback difference measure FBDM via signal DIFF.

The listening devices (LD-1, LD-2) each further comprise a probe signal generator (PSG) for generating a probe signal adapted to be used in an estimation of the feedback path from the speaker (SP) to the microphone (MIC). The activation and control of the probe signal generator PSG is performed by the signal processing unit (DSP) via signal PSC. The probe signal (PrS) may comprise a number or predetermined pure tones, a white noise signal, or masked noise, etc. The forward path further comprises a mixer/selector unit (MIX) for mixing or selecting between inputs PrS (probe signal) and PS (processed signal from the signal processing unit). The mixer/selector unit (MIX) is controlled by the signal processing unit (DSP) via signal SeIC. The control of the mixer/selector unit (MIX) may alternatively or additionally be influenced via the user interface (UI) and control signal UC. In an embodiment, the forward path of the listening devices comprises a decorrelation unit for lowering the autocorrelation of a signal of the forward path (and lowering the cross-correlation between the output signal OUT and the input signal IN). This decorrelation unit may e.g. be applied to a signal of the forward path in particular modes of operation and made inactive in other modes of operation. In an embodiment, the decorrelation unit applies a frequency shift to the signal, e.g. a frequency shift lower than 30 Hz, e.g. 20 Hz or 10 Hz or lower.

In the embodiment of FIG. 1*f*, the listening devices (LD-1, LD-2) each comprise wireless transceivers (ANT, Rx/Tx) for receiving a wireless signal (e.g. comprising an audio signal and/or control signals) from an auxiliary device, e.g. an audio gateway device and/or a remote control device. The listening devices each comprise a selector/mixer unit (SEL/MIX) for selecting either of the input audio signal INm from the microphone or the input signal INw from the wireless receiver unit (ANT, Rx/Tx) or a mixture thereof, providing as an output a resulting input signal IN. In an embodiment, the selector/mixer unit can be controlled by the user via the user interface (UI), cf. control signal UC and/or via the wirelessly received input signal (such input signal e.g. comprising a corresponding control signal or a mixture of audio and control signals). In the embodiment of FIG. 1*f*, an extraction of a selector/mixer control signal SELw is performed in the wireless receiver unit (ANT, Rx/Tx) and fed to the selector/mixer unit (SEL/MIX).

Figure 2A:
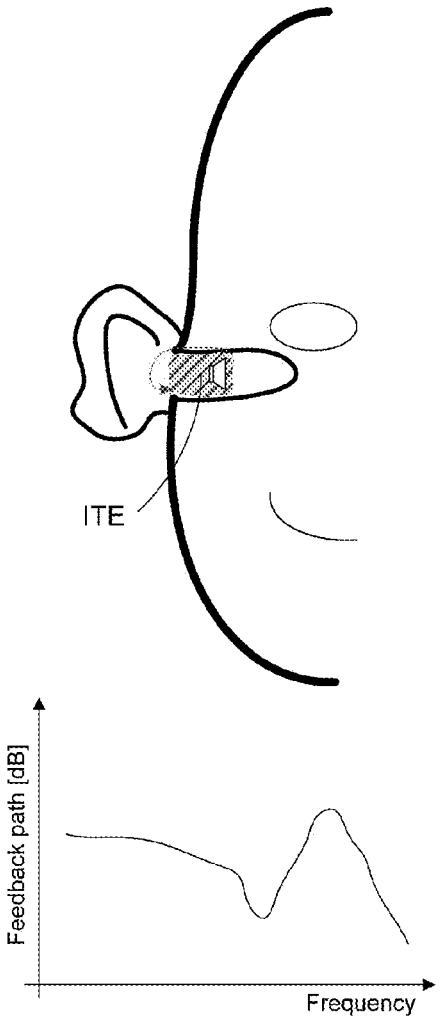
FIG. 2 shows two examples of an ear mould of a listening device when mounted in an ear canal of a user, the ear mould comprising a loudspeaker for generating a sound into the volume between the mould and the ear drum of said ear canal, FIG. 2*a* illustrating (top) a situation where the ear mould is relatively tightly fit to the walls of the ear canal, and (bottom) a corresponding frequency dependent feedback, FIG. 2*b* illustrating (top) a situation where the ear mould is less tightly fit to the walls of the ear canal (because the ear canal has grown), thereby allowing a leakage of sound from said volume to the environment, and (bottom) a corresponding frequency dependent feedback, the increased feedback being indicated by the arrows at different frequencies.
Figure 2B:
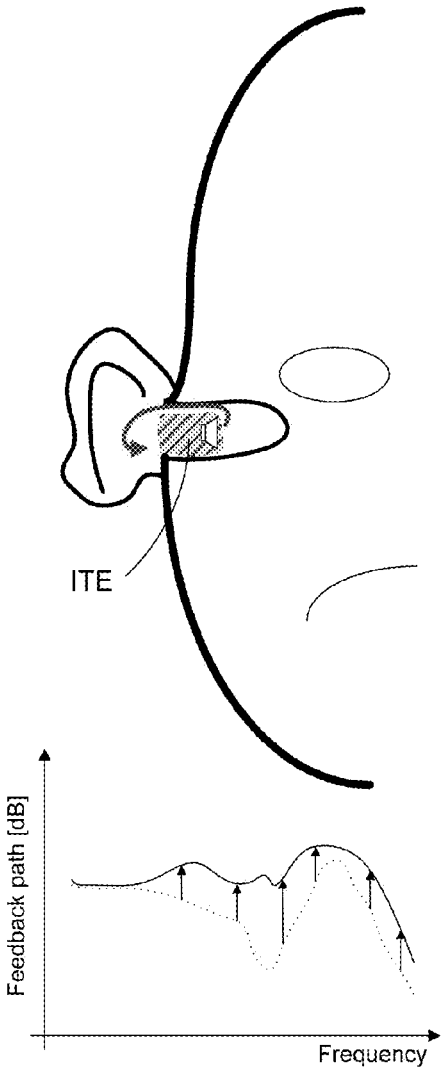

FIG. 2 shows two examples of an ear mould (ITE part, grey hatched body, ITE) of a listening device when mounted in an ear canal of a user, the ear mould comprising a sound outlet, e.g. a loudspeaker for generating a sound into the volume between the mould and the ear drum of said ear canal, FIG. 2*a* illustrating (top) a situation where the ear mould is relatively tightly fit to the walls of the ear canal, and (bottom) a corresponding frequency dependent feedback, FIG. 2*b* illustrating (top) a situation where the ear mould is less tightly fit to the walls of the ear canal (because the ear canal has grown in cross section), thereby allowing a leakage of sound from said volume to the environment, and (bottom) a corresponding frequency dependent feedback, the increased feedback being indicated by the arrows at different frequencies. FIG. 2*b* illustrates an increased feedback (leakage) from the loudspeaker of the ear mould to a microphone located in a part of the ear mould facing towards the surroundings compared to FIG. 2*a*, e.g. because the ear canal has grown over time compared to the example of FIG. 2*a*. The microphone may be located elsewhere in the listening device than what is implicated in FIG. 2, e.g. in a part adapted for being mounted in the outer ear or behind the ear (BTE) of a user.

When an ear mould is too small (FIG. 2*b*, right), the feedback path (bold arrow from loudspeaker to environment) deviates from the optimal feedback path (FIG. 2*a*, left, thin arrow). If a reliable (current) feedback path and IGmax estimate can be determined within a short duration of time, the (current) estimate may be compared to a long term estimate, and if the deviation between the two is too high or if the IGmax value is below a predefined value, a warning may be issued (e.g. via an alarm indication unit) telling a user or another person that the ear mould should be attended to.

Figure 3A:
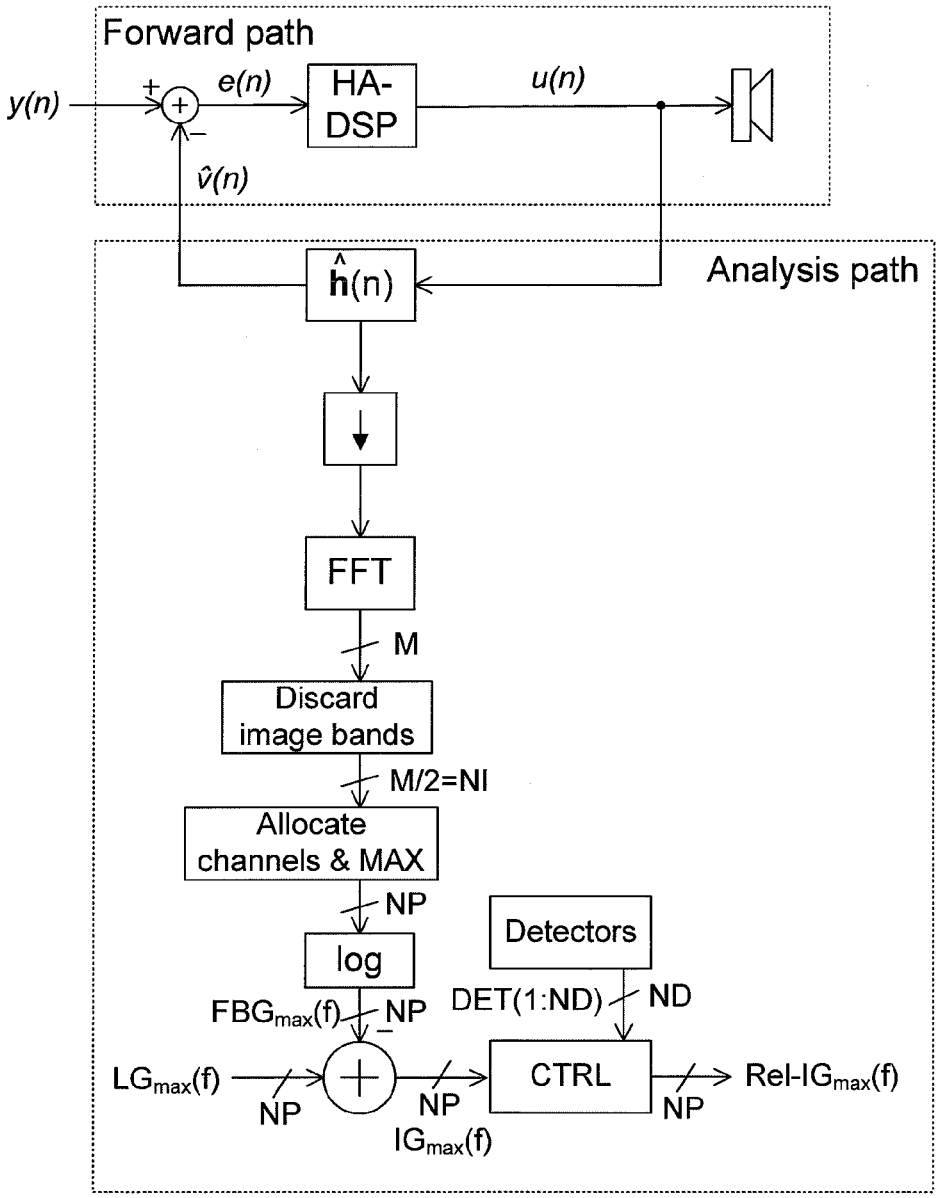
FIG. 3 illustrates a method of extracting reliable IGmax values in a number of frequency channels from the feedback path estimate of a DFC system forming part of a listening device (FIG. 3*a*) and a part of a listening device comprising processing in a number of frequency channels NP based on a time to time-frequency conversion unit providing a larger number of frequency bands NI than channels NP (FIG. 3*b*)

FIG. 3*a* shows a part of a listening device comprising a Forward path for applying gain to an input signal and an Analysis path for providing a reliable (current) estimate of the feedback path. The Forward path is indicated by the dotted rectangular enclosure and the Analysis path is indicated by the solid rectangular enclosure. The Forward path comprises sum unit ('+'), signal processing unit HA-DSP and a loudspeaker. The input signals to the sum unit ('+') are an audio signal y(n) picked up by (or received by) an input transducer, e.g. a microphone, and a feedback path estimate $\hat{v}(n)$ from a feedback estimation unit (here unit $\hat{h}(n)$), respectively. The resulting output e(n) of the sum unit (which is an input to the signal processing unit HA-DSP) is a feedback corrected input audio signal comprising the input audio signal y(n) less the feedback path estimate $\hat{v}(n)$. The signal processing unit HA-DSP is adapted to enhance the feedback corrected input audio signal e(n) and to provide a processed output signal u(n) which is fed to the loudspeaker and to the feedback estimation unit $\hat{h}(n)$. The signals are indicated in the time domain (time index n). The symbol $\hat{h}(n)$ of the feedback estimation filter unit is intended to indicate an impulse response of the nit, and the output signal $\hat{v}(n)$ of $\hat{h}(n)$ is determined from the input signal u(n) to the unit by a linear convolution of the input signal with the impulse response of the unit ($\hat{h}(n)$). The signal processing in the forward path performed in signal processing unit HA-DSP may be performed fully or partially in the time domain or in the frequency domain and may or may not comprise frequency transposition. The Analysis path comprises adaptive feedback estimation filter $\hat{h}(n)$ for repeatedly ('continuously') providing an estimate of the feedback path. The current feedback path estimate is extracted from the feedback path estimation filter $\hat{h}(n)$. A frequency domain representation of the feedback path estimate is e.g. obtained by a fast Fourier transform (FFT). This transformation can be carried out for every update of the feedback path estimation filter $\hat{h}(n)$ or it can be down-sampled by e.g. only updating the frequency domain representation with a predefined update frequency $f_{ds}$, every $1/f_{ds}$, e.g. every 500 ms. In the embodiment of FIG. 3*a*, the repeatedly generated feedback filter estimate $\hat{h}(n)$ is possibly down-sampled or decimated (cf. block '↓') and concerted into the frequency domain, e.g. using a fast Fourier transformation (cf. block FFT) with M frequency bins or bands, e.g. a 512 point FFT, of the down-sampled or decimated feedback path estimate. The contents of the M (512) FFT-bins are symmetric (because the input signal to the FFT-algorithm is real) and only half of them M/2=NI (e.g. 256) are needed to represent the input signal (to the FFT) in the frequency domain (hence the M/2=NI on the output of the Discard image bands block indicating the total number of frequency bands constituting the channels). Because the listening device processing is preferably performed in channels that are wider than the (typically equal width) FFT bands, the frequency domain bands (e.g. 256) are (optionally) divided into a number NP of channels (e.g. 16 channels) (cf. block Allocate channels & MAX, and e.g. FIG. 3*b*, providing a linear to non-linear band mapping), each channel comprising a number of frequency bands (possibly different for different channels, cf. FIG. 3*b*). Within each channel, the maximum feedback path estimate is extracted (worst case) in a number of selected channels, e.g. in all channels (cf. block Allocate channels & MAX providing MAX(|FBG($FB_{ji}$)|), $FB_{ji}$ being the frequency bands constituting channel j). The value of maximum feedback gain $FBG_{max}$ may (optionally) be converted into dB (cf. unit log and output value $FBG_{max}(f)$) and converted to (minimum) maximum insertion gain (cf. sum unit '+' and output value $IG_{max}(f)$) in each frequency channel. $IG_{max}(f)$ values for each channel are determined from predetermined values of maximum acceptable loop gain $LG_{max}(f)$ (LG=IG+FBG and hence IG=LG−FBG). The predefined maximum loop gain values $LG_{max,j}$ may be different from frequency channel to frequency channel. The predefined maximum loop gain $LG_{max,j}$ in a particular frequency channel j is e.g. determined from an estimate of the maximum allowable loop gain before howling occurs ($LG_{howl,j}$) diminished by a predefined safety margin ($LG_{margin,j}$). In an embodiment, the predefined maximum loop gain values $LG_{max,j}$ are determined on an empirical basis, e.g. from a trial and error procedure, e.g. based on a user's typical behaviour (actions, environments, etc.). In an embodiment, the predefined maximum loop gain values are identical for all frequency channels, j=1, 2, . . . , NP. In an embodiment, the predefined maximum loop gain values are smaller than or equal to 0 dB, such as smaller than or equal to −2 dB, smaller than or equal to −6 dB. In an embodiment, the predefined maximum loop gain values are smaller than or equal to +12 dB, or +10 dB, or +5 dB, or +2 dB. The NP $IG_{max}(f)$ values are fed to a control unit CTRL (cf. also Control Unit in FIG. 4) further receiving inputs in the form of detector signals $DET_1, DET_2, \ldots, DET_{ND}$ from a number ND of detectors. The control unit CTRL contains a criterion for—based on said detector signals—deciding whether an estimate of the current IGmax value of a given frequency channel is reliable (corresponding to whether a current estimate of a feedback path is reliable). The outputs of the control unit CTRL thus comprise NP reliable $IG_{max}(f)$−values (signals Rel-$IG_{max}(f)$ in FIG. 3*a*).

Figure 3B:
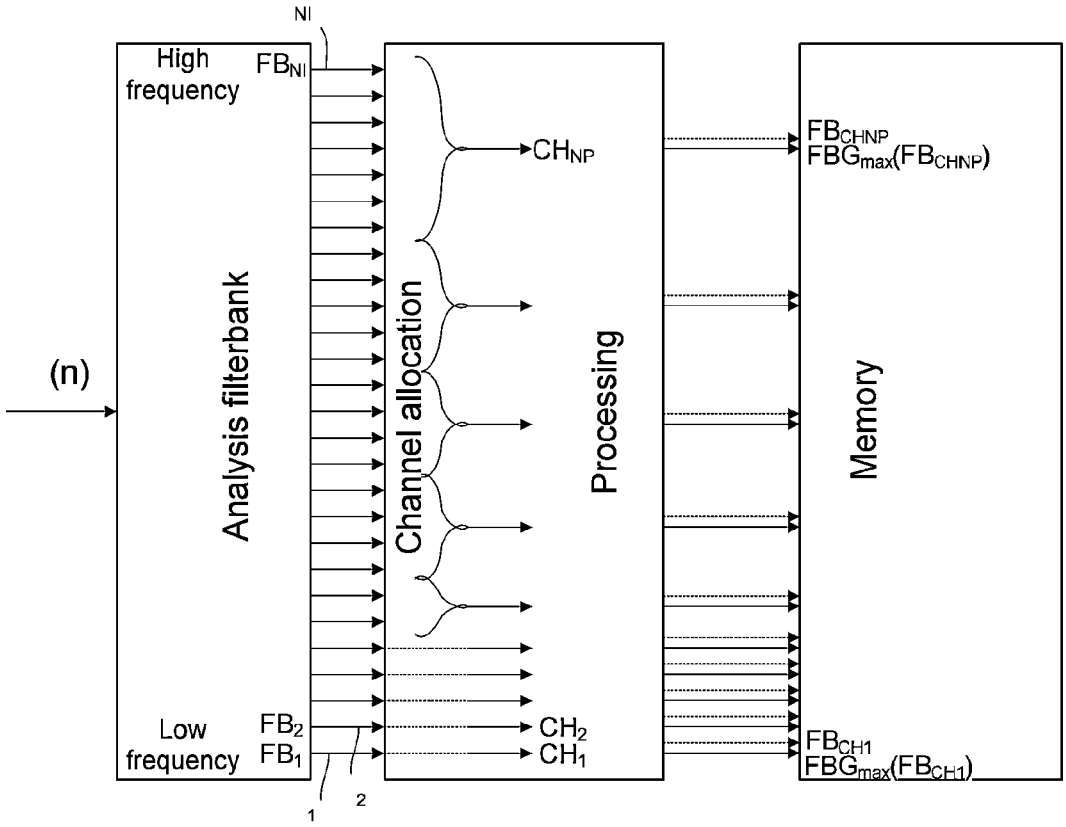

FIG. 3*b* illustrates a part of a listening device comprising processing in a number of frequency channels NP based on a time to time-frequency conversion unit providing a larger number of frequency bands NI than channels NP, and where a frequency band allocation unit provides allocation of a number of frequency bands to each of the different frequency channels. The part of a listening device of FIG. 3*b* comprises an Analysis filterbank (e.g. comprising a DFT algorithm, such as an FFT algorithm) to split a time domain input signal F(n) (representing a feedback path estimate) into a number NI of frequency band signals $F_1, F_1, \ldots, F_{NI}$, in respective frequency bands $FB_1, FB_2, \ldots, FB_{NI}$, which are fed to a Channel allocation and Processing unit, where the maximum value $FBG_{max}$ of the frequency band signals $F_{i,j}$ corresponding to a particular channel j is identified (for each channel $CH_j$, j=1, 2, . . . , NP). The resulting values of maximum feedback $FBG_{max}(FB_{CHj})$ and corresponding frequency band $FB_{CHj}$ within each channel j=1, 2, . . . , NP are stored in a Memory unit. Alternatively or additionally, corresponding values of $IG_{max}$ and frequency bands FB may be stored in the Memory unit. The outputs of the Channel allocation and Processing unit of FIG. 3*b* may be identical to the output of the Allocate channels & MAX unit of FIG. 3*a*. Alternatively, the further processing of FIG. 3*a* involving qualifying the current feedback path estimates to reliable current feedback path estimates based on the outputs of a number of detectors (and conversion to corresponding IGmax values) may be included in the Channel allocation and Processing unit of FIG. 3*b*, so that the values stored in the memory unit are corresponding values of reliable IGmax estimates and frequency bands (i.e. Rel-IGmax($FB_{CHj}$), $FB_{CHj}$).

The input audio signal (e.g. received from a microphone system of the listening device or as here from a feedback estimation unit (or a down-sampled version thereof), cf. $\hat{h}(n)$ (or ↓) in FIG. 3*a*) has its energy content below an upper frequency in the audible frequency range of a human being, e.g. below 20 kHz. The listening device is typically limited to deal with signal components in a subrange [$f_{min}$; $f_{max}$] of the human audible frequency range, e.g. to frequencies below 12 kHz and/or frequencies above 20 Hz. In the Analysis filterbank of FIG. 3*b*, the input frequency band signals $F_1$, $F_1, \ldots, F_{NI}$, representing values of the input signal F(n) in the frequency range from $f_{min}$ to $f_{max}$ (represented by frequency bands $FB_1, FB_2, \ldots, FB_{NI}$) considered by the listening device are indicated by arrows from the Analysis filterbank to the Channel allocation and Processing unit. The frequency bands are arranged with increasing frequencies from bottom (Low frequency) to top (High frequency) of the drawing. The Channel allocation unit is adapted to allocate input frequency bands $FB_1, FB_2, \ldots, FB_{NI}$ to a reduced number of processing channels $CH_1, CH_2, \ldots, CH_{NP}$ in a predefined manner (or alternatively dynamically controlled). Each frequency band signal $F_1, F_2, \ldots, F_{NI}$ comprises e.g. a complex number representing a magnitude and phase of that frequency component of the signal (at a particular time instant). In the embodiment of FIG. 3*b*, the 5 lowest input frequency bands are each allocated to their own processing channel, whereas for the higher input frequency bands more than one input frequency band are allocated to the same processing channel. In the exemplary embodiment of FIG. 3*b*, the number of input frequency bands allocated to the same processing channel is increasing with increasing frequency. Any other allocation may be appropriate depending on the application, e.g. depending on the input signal, on the user, on the environment, etc.

A long term estimate of the feedback path (or corresponding IGmax values) is discussed in WO 2008/151970 A1 in the framework of a so-called Slow Online FeedBack Manager (OFBM).

Figure 4:
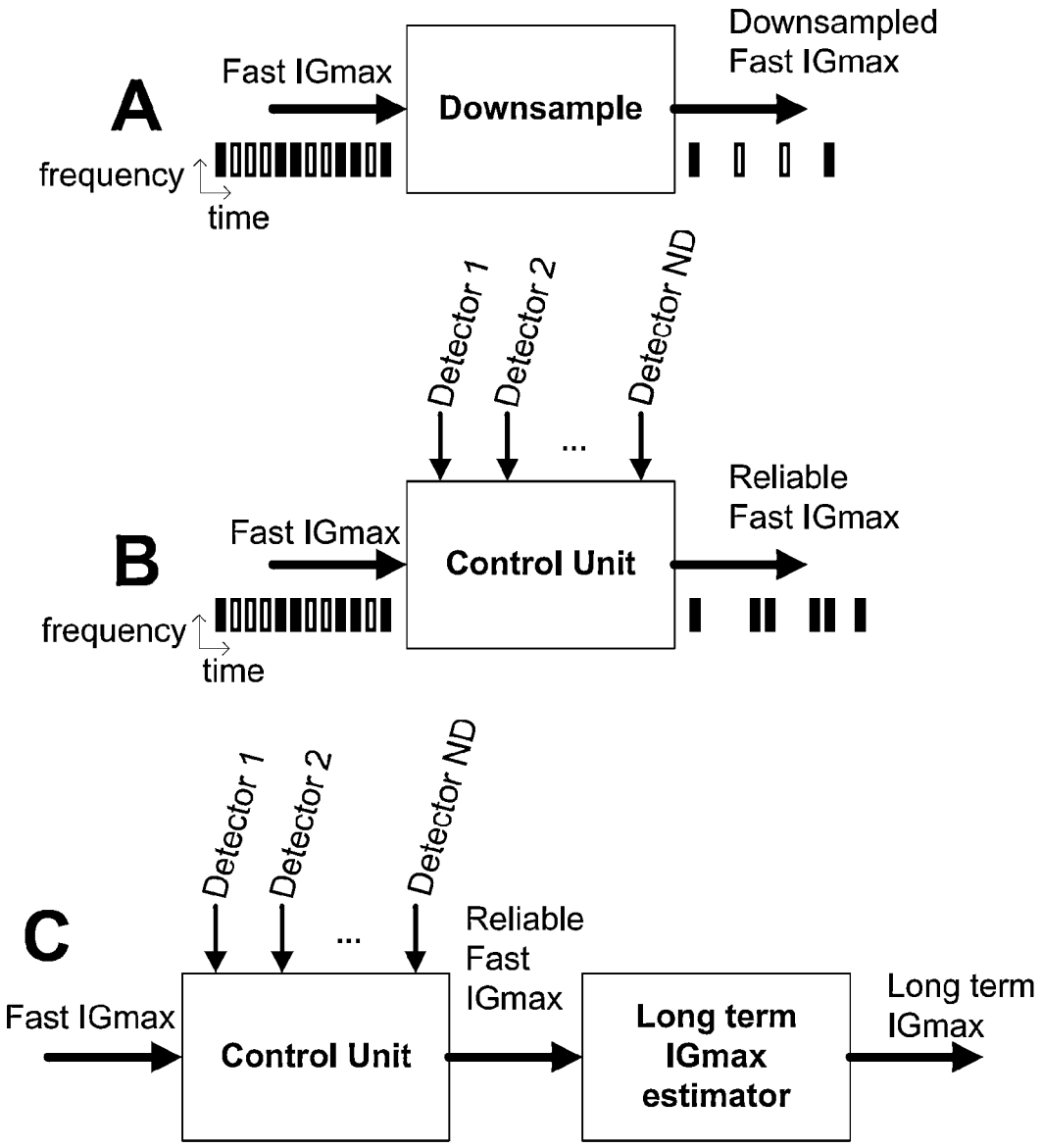
FIG. 4 illustrates down-sampling of an instant feedback path estimate (FIG. 4*a*) and detector output information being utilized for filtering out erroneous current IGmax estimates to provide reliable current IGmax estimates (FIG. 4*b*), and the provision of long term IGmax estimates (FIG. 4*c*)

FIG. 4 shows illustrates down-sampling of an instant feedback path estimate (FIG. 4*a*) and detector output information being utilized for filtering out erroneous current IGmax estimates to provide reliable current IGmax estimates (FIG. 4*b*), and the provision of long term IGmax estimates (FIG. 4*c*). FIG. 4 illustrates current slow OFBM logging of fast IGmax values (top part, A, cf. WO 2008/151970A1), and a proposal for an optimization (bottom part, B). IGmax estimates are illustrated with either a black (good estimate) or a grey (erroneous estimate), each symbol representing a time frame of the input signal (FAST IGmax) comprising a number of frequency bins, each time-frequency bin holding a complex or real value representing the signal at a particular frequency and time. A: Current slow OFBM logging of Fast IGmax estimates are carried out by a regular logging i.e. downsampling (cf. block Downsample) of the fast estimates (cf. also block '↓' in FIG. 3*a*). This method does not allow one to separate the erroneous (unreliable) IGmax estimates from the good (reliable) ones, the Downsampled Fast IGmax values comprising a smaller number of Fast IGmax values, but still a mixture of reliable and unreliable values. B: By using detector outputs (cf. signals Detector 1, Detector 2, . . . , Detector ND), containing information about the situations (i.e. points in time) where the fast IGmax estimates are erroneous (or reliable), the erroneous (or unreliable) values of IGmax can be filtered out in a logical control unit (cf. block Control Unit) based on a predefined criterion for the combination of values of the detector signals. The resulting Reliable Fast IGmax values comprise only reliable values of Fast IGmax. A valid sample efficiency may be defined based on the number of valid samples (output) relative to the total number of samples (input). An effective sample rate $f_{s,eff}$ may be defined as the number of valid samples per time unit. In an embodiment, the effective sample rate is determined as the number of valid samples $N_{vs}$ counted in the last hour (i.e. $f_{s,eff}=N_{vs}(1\ h)/3600\ s$). In an embodiment, the control unit comprises down-sampling as well as selection. The down-sampling may be performed before or after the logic selection of valid IGmax estimates, depending on the practical application. FIG. 4*c* illustrates the use of the Reliable Fast IGmax values to provide Long term IGmax values using Long term IGmax estimator block, which e.g. comprises an algorithm for combining (e.g. averaging) reliable (fast or current) IGmax values to provide the long term (or slow) IGmax values. An algorithm may e.g. have the form IGmax,LT(n,k)=α·IGmax,CUR(n,k)+(1−α)·IGmax,LT(n−1,k), where n and k are time and frequency indices, respectively, CUR refers to reliable current (or fast) estimates and LT to long term (or slow) estimates, and α is a parameter between 0 and 1 controlling an adaptation rate of the long term estimate towards the current estimate.

Figure 5A:
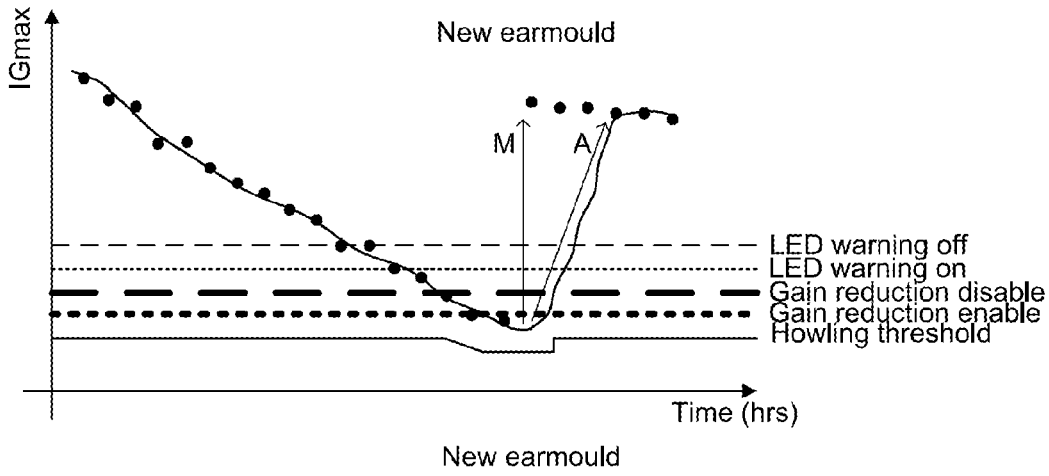
FIG. 5 illustrates the use of the long term IGmax estimate, the graph showing current IGmax (black dots) and estimated long term IGmax (black line) for a single frequency and how it develops over time a) as the leakage around the ear mould of a child increases (FIG. 5*a*) and b) when a substantial growth of the ear canal has occurred (FIG. 5*b*)
Figure 5B:
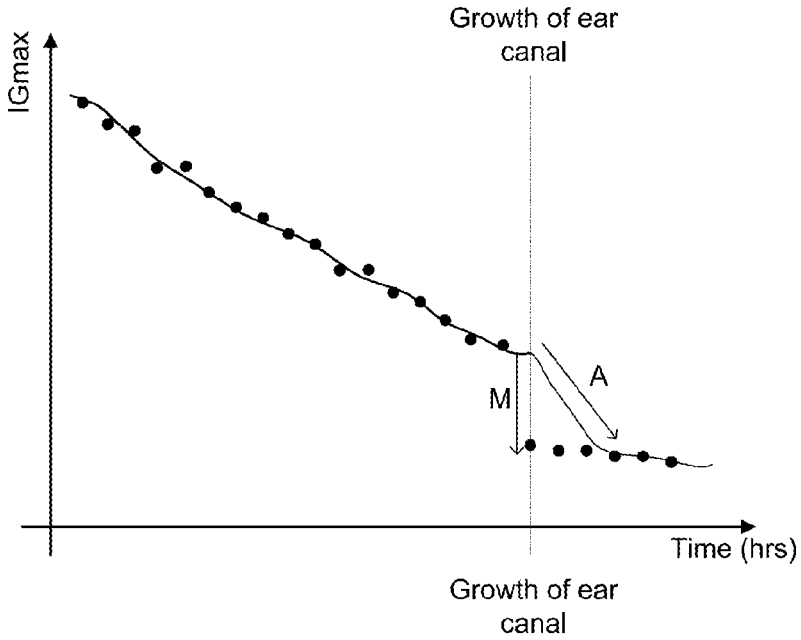

FIG. 5 illustrates the use of the long term IGmax estimate, the graph showing reliable (fast) current IGmax (dots) and estimated long term IGmax (solid graph) for a single frequency f (e.g. corresponding to a single channel) and how it develops over time a) as the leakage around the ear mould of a listening device for a child increases (FIG. 5*a*) and b) when a substantial growth of the ear canal has occurred (FIG. 5*b*).

At some time before the leak gets critically high, e.g. in that the device starts to howl, one or both of the following actions may be initiated in the listening device:

- the parents (or other caring person) of the child wearing the listening device are warned that the ear mould has to be changed, and
- the gain of the listening device is reduced to prevent the device from howling.

Preferably, as indicated in FIG. 5*a*, the actions in the listening device are sequentially performed: First, a warning is issued (cf. LED warning on) when the IGmax(f) value falls below the LED warning threshold (cf. thin dotted line). Second, gain of the listening device is reduced (cf. Gain reduction enable) when the IGmax(f) value falls further and below the gain reduction threshold (cf. bold dotted line). A Howling threshold (for the frequency in question) is indicated by the lower solid horizontal line. When gain reduction is enabled, and the requested gain thus reduced, the margin to the howling threshold increases (temporarily, until the ear canal has grown further). This is illustrated in FIG. 5*a* by the reduction in Howling threshold (around the 'New earmould'-indication). An exchange of the ear mould is indicated at the time corresponding to the vertical dashed line denoted New earmould. The mentioned actions may be introduced independently in each frequency band or channel. Alternatively, and preferably, a criterion combining the IGmax data for at least some of the frequency bands or channels is introduced for governing whether the above actions are initiated in the listening device.

In FIG. 5*a* it is assumed that the listening device (and/or an associated device, e.g. a remote control, or an audio gateway, or another device, e.g. a smart phone or a baby alarm, adapted for receiving an alarm signal from the listening device and visualizing (e.g. displaying) an associated message) comprises a visual indicator (e.g. a display or a light source, e.g. a light emitting diode (LED)) allowing the user and/or a caring person (e.g. a parent of a child) to receive an information about the status of the fitting of the ear mould. FIG. 5*a* illustrates how LED warning and gain reduction thresholds can be used to turn on/off and enable/disable an LED warning and a gain reduction, respectively. As illustrated in FIG. 5*a*, the off/disable thresholds can be greater than the on/enable thresholds to implement some hysteresis, preventing LED warnings and gain reductions from being repeatedly turned on/off and enabled/disabled when the long term IGmax fluctuates a little around the thresholds.

Different threshold can be enforced for the different frequency channels and the activation of the LED warning and gain reduction can be determined by the number of frequency channels where the on/enable threshold are surpassed. E.g. if the LED warning on thresholds are surpassed in two of the frequency channels, the LED warning can be turned on.

Instead of an LED, other alarm generators may alternatively or additionally be used. Examples hereof are a display, a loudspeaker, a beeper, etc.

The exchange of the ear mould (indicated by the vertical dotted line in FIG. 5*a*) can be communicated to the listening device by an audiologist via a programming interface or via a user interface of the listening device (e.g. a remote control, e.g. an audio gateway integrated with a remote control device). Simultaneously, the warnings, including the LED warning, should be disabled. This is implied by the arrow M intended to indicate that revised long term feedback path (or IGmax) estimates have been stored in the listening device allowing it to continue the monitoring of IGmax-deviations from the new (improved) level. Alternatively, the listening device is adapted to automatically identify that the ear mould has been exchanged (in that current feedback has been substantially and consistently reduced, and hence current IGmax (reliable IGmax,fast) correspondingly increased). Such identification that feedback has been substantially decreased should lead to an increased frequency of updating the long term feedback estimates that are used to provide reliable long term IGmax values (IGmax,slow). This will result in a relatively fast, but gradual, adaptation of the long term IGmax values to the new situation. Alternatively, after it has been determined that a new ear mould is in use, the current (reliable) feedback path estimate may be used as the (new) long term feedback estimate (stored as long term estimates). The automatic procedure is implied by arrow A intended to indicate an automatic adaptation of the long term IGmax values to the new situation. When the new relevant levels of long term IGmax values have been reached, the frequency of updating the long term feedback estimates used to provide reliable long term IGmax values can be decreased to a lower value (e.g. the previously used value). Thereby the warnings including the LED warning can be relatively quickly (and automatically) disabled.

In an embodiment, an update algorithm for reliable long term IGmax values IGmax,slow(t,f) is given by:

$$IG\text{max,slow}(t,f)=\alpha\cdot IG\text{max,fast}(t,f)+(1-\alpha)\cdot IG\text{max,slow}(t-1,f),$$

where IGmax,fast(t,f) is a reliable current value, α is a parameter between 0 and 1 determining an adaptation rate, t is time, f is frequency and 't−1' indicates the previous time instance, for which a reliable value of IGmax,slow is available.

A method for implementing an automatic procedure for adapting long term IGmax values at a given frequency to a change of mould may e.g. comprise a) identifying that reliable IGmax,fast>>IGmax,slow (e.g. more than 6 dB larger); b) increasing an update rate of an algorithm for determining long term estimates IGmax,slow from current reliable estimates IGmax,fast, e.g. by increasing parameter α of the update algorithm(e.g. to $\alpha_{fast}$); and c) decreasing the update rate (e.g. to $\alpha_{slow}$), when reliable IGmax,fast~IGmax,slow.

Another situation where an (automatic) procedure for (a relatively fast) adaptation of long term IGmax values to a changed situation is advantageous may occur, if a child user does not use the listening device(s) for an extended period (days/weeks) long enough for the child's ear canal to have grown and thus leakage to increase as illustrated in FIG. 5*b*. In an embodiment, an indication by a user (or a caring person) via a user interface is used to activate a faster update procedure for long term IGmax values.

In an embodiment, a method for implementing an automatic procedure for adapting long term IGmax values at a given frequency to a substantial growth of the ear canal may e.g. comprise a) identifying that reliable IGmax, fast<<IGmax,slow (e.g. more than 6 dB smaller); b) increasing an update rate of an algorithm for determining long term estimates IGmax,slow from current reliable estimates IGmax,fast, e.g. by increasing parameter $\alpha$ of the update algorithm(e.g. to $\alpha_{fast}$); and c) decreasing the update rate (e.g. to $\alpha_{slow}$), when reliable IGmax,fast~IGmax,slow.

In another embodiment, an automatic procedure is provided based on a comparison of the long term (LT) and current (CUR) IGmax values (e.g. the IGmax difference measure IGDM, e.g.

$$IGDM=SUM[IG\max_{LT}(f_i)-IG\max_{CUR}(f_i)]\ [\mathrm{dB}],\quad i=1,2,\ldots,N_{FBE},$$

where $IG\max_{LT}(f_i)$ and $IG\max_{CUR}(f_i)$ are assumed to be given in dB and $N_{FBE}$ is the number of frequencies/frequency channels contributing to IGDM). In an embodiment, an adaptation rate of long term IGmax is increased, if the IGmax difference measure IGDM is larger than a predefined threshold value, e.g. for a predefined amount of time after a power-up of the listening device (e.g. for at least 1 minute). If this criterion is fulfilled, the adaptation rate of long term IGmax is increased (e.g. to $\alpha_{fast}$) to provide a convergence of the long term IGmax algorithm (towards the new level of IGmax corresponding to a grown ear canal) within a predefined (shorter than normal) time, e.g. within 10 minutes or within 1 hour (where after the adaptation rate is preferably takes on its previous value, e.g. $\alpha_{slow}$). Alternatively, the long term estimate is reinitialized, e.g. by setting the long term estimate equal to a (reliable) current estimate.

In an embodiment, an algorithm for issuing and disabling a warning (e.g. via an LED) to the user based on the inputs from the individual frequency bands is implemented. In an embodiment, the warning is issued, if the warning level (e.g. a specific warning-on level) in one or more (e.g. in just one) frequency band(s) is(are) exceeded. In an embodiment, the warning is disabled, if the warning level (e.g. a specific warning-off level) in a predetermined number of (e.g. all) frequency bands is no longer exceeded.

In an embodiment, wherein a binaural listening system is considered, a conclusion concerning the application of a new ear mould (on both ears) is made dependent on a simultaneous detection of a substantial feedback reduction (increase in IGmax) in both listening devices of the binaural system.

In an embodiment, the warning is forwarded from a listening device to another device for presentation to a user (or a caring person). In an embodiment, the other device comprises a display whereon the warning is indicated (e.g. in addition to an acoustic and/or vibrational indication). In an embodiment, the other device comprises one or more of a remote control, an audio gateway, a cellular phone (e.g. a smart phone), an FM transmitter (e.g. for a wireless microphone), and a baby alarm device).

Figure 6:
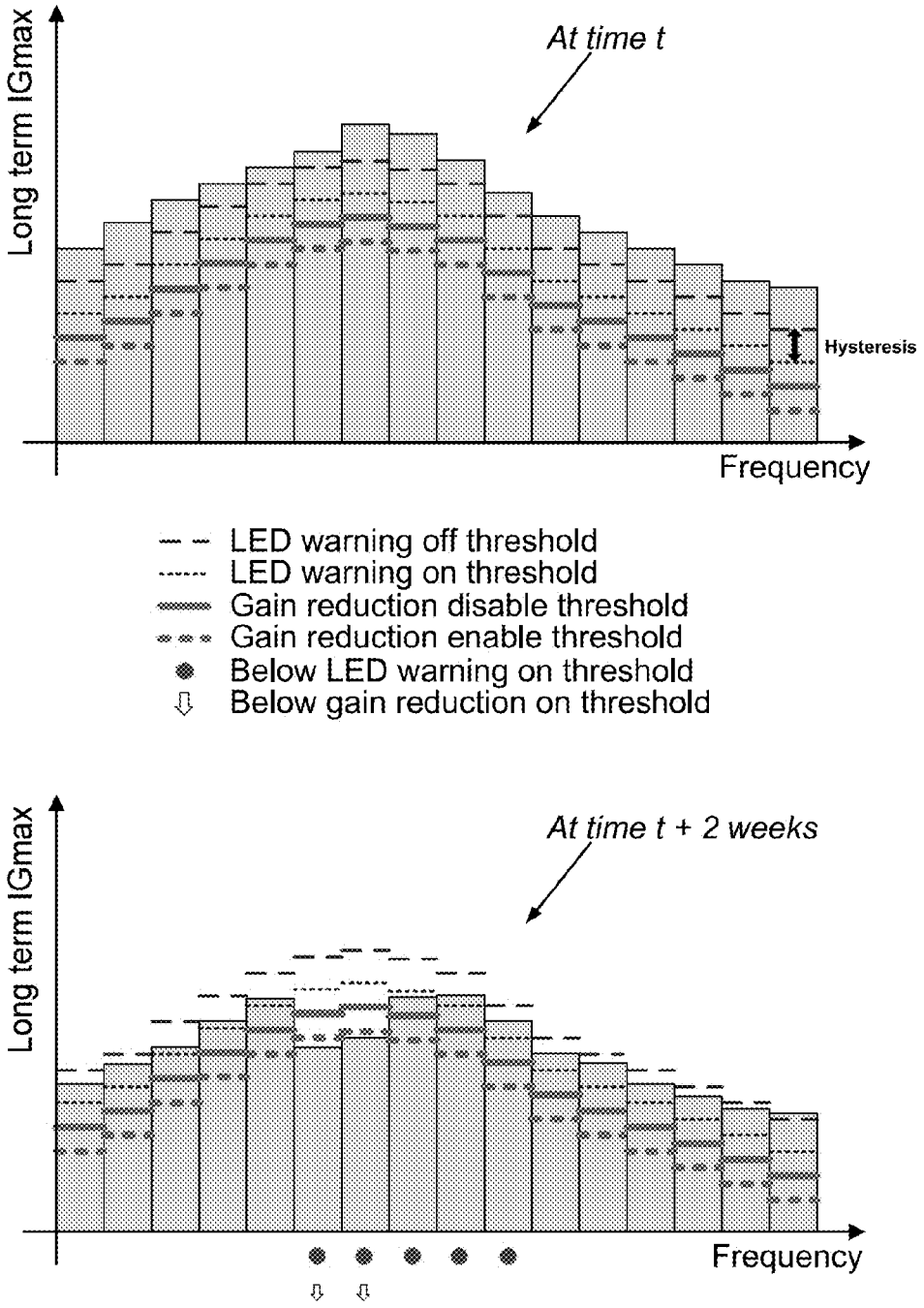
FIG. 6 shows an exemplary progression of the long term IGmax estimates within the different frequency channels, wherein thresholds are surpassed at different time instances.

FIG. 6 shows an exemplary progression of the long term IGmax estimates within the different frequency channels, wherein thresholds are surpassed at different time instances. FIG. 6 shows how the long term IGmax can develop differently over time within the different frequency channels and how the thresholds thus also are surpassed at different time instances. The top graph shows the values of long term IGmax-estimates at different frequencies (e.g. in a number of channels) at a specific point in time t. The frequency dependent thresholds discussed in connection with FIG. 5 are indicated as follows (in falling order of level):

LED warning off threshold - - - (thin dashed line)
LED warning on threshold . . . (thin dotted line)
Gain reduction disable threshold _____ (bold solid line)
Gain reduction enable threshold - - - (bold dashed line)

In the top graph, the long term IGmax-estimates are larger than the LED warning off threshold (the largest of the thresholds) at all frequencies. The bottom graph is identical in character to the top graph, only illustrating a situation at a later point in time (2 weeks later). The values of the long term IGmax-estimates at different frequencies have decreased and some of them are lower than one or both of the 'activity enable' thresholds LED warning on threshold and Gain reduction enable threshold, respectively. As indicated with symbols (bold dot and arrow down) below the frequency axis of the bottom graph, long term IGmax estimates are below the LED warning on threshold for five of the frequencies and below the Gain reduction enable threshold for two of the frequencies. An appropriate criterion for issuing an alarm indication based on the results for the different frequencies can be applied to arrive at a resulting action in the listening device.

EXAMPLE

Securing a Good Long Term Estimate of IGmax

An example of the functionality of the control unit can be described with the equation $$\begin{aligned}&\mathrm{UPDATE_ENABLE}(f)=\mathrm{DET1}(f)<\mathrm{DET1_THR}(f)\ \&\\&\quad \mathrm{DET2}(f)<\mathrm{DET2_THR}(f)\ \&\ \mathrm{DET3}(f)\\&\quad <\mathrm{DET3_THR}(f)\ \&\ \mathrm{DET4}(f)<\mathrm{DET4_THR}(f)\ \&\\&\quad \mathrm{COUNTER}(f)==0\ \&\ IG\max_\mathrm{slow}(f)-\\&\quad IG\max_\mathrm{fast}(f)<IG\max_\mathrm{offset}(f)\end{aligned}$$

where the UPDATE_ENABLE(f) is a boolean variable that indicates if the long term IGmax estimate should be updated (1) or not (0). The update is carried out for each frequency channel and is based on the condition that each detector output must be below a given threshold. Other numbers of detectors (smaller or larger) than four can of course be used, e.g. two or more, such as three or more. Other logical operations than 'smaller than a threshold' may of course be used as sub-criteria (e.g. 'larger than a threshold' or 'within in a certain range', etc.).

The two last conditions may be optional.

The COUNTER(f)==0 condition can be used to assure that the detector criteria must have been fulfilled for a given time before an update is carried out. The reason for this is that it might take some time for the DFC system to converge to a good estimate of the feedback path after the detection of an unfavourable situation. In other words the time lag introduced by the COUNTER(f)==0 condition (starting from a COUNTER(f)=max_count(f)) allows a certain time for algorithms to reach a stable (and trustworthy) state.

The IGmax_slow(f)−IGmax_fast(f)>IGmax_offset(f) condition can be included to filter out outliers, i.e. fast IGmax estimates that deviate too much from the long term IGmax estimate (IGmax_slow(f)). Such extreme values of current feedback path estimates (resulting in corresponding extreme values of IGmax_fast) may of course be detected also by one of the detectors. The present condition can be viewed as a detector in the sense of the present disclosure.

Figure 7:
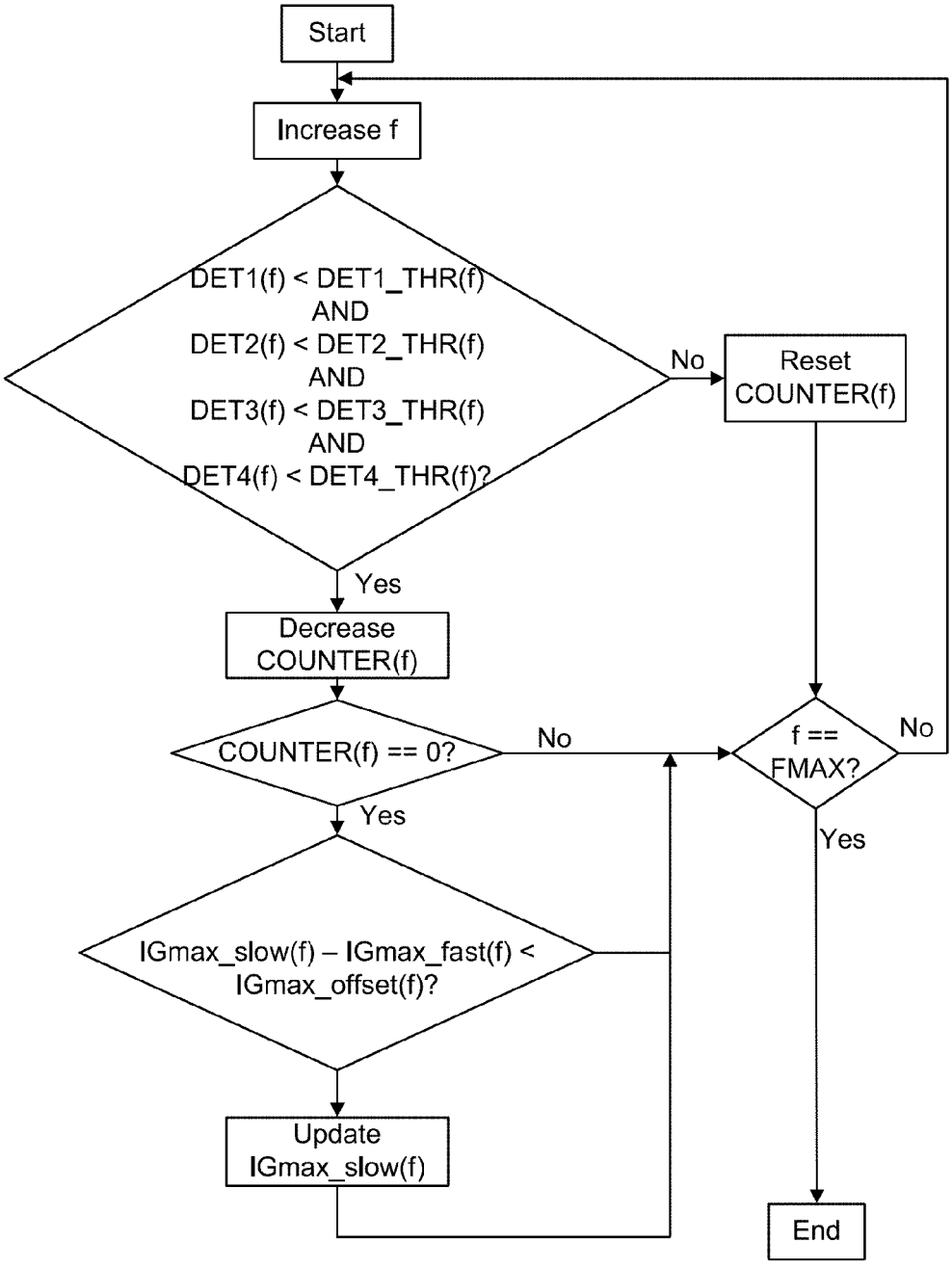
FIG. 7 shows an exemplary flow chart for implementation of a control unit based on an update equation for the long term estimate of IGmax according to the present disclosure.
Figure 8:
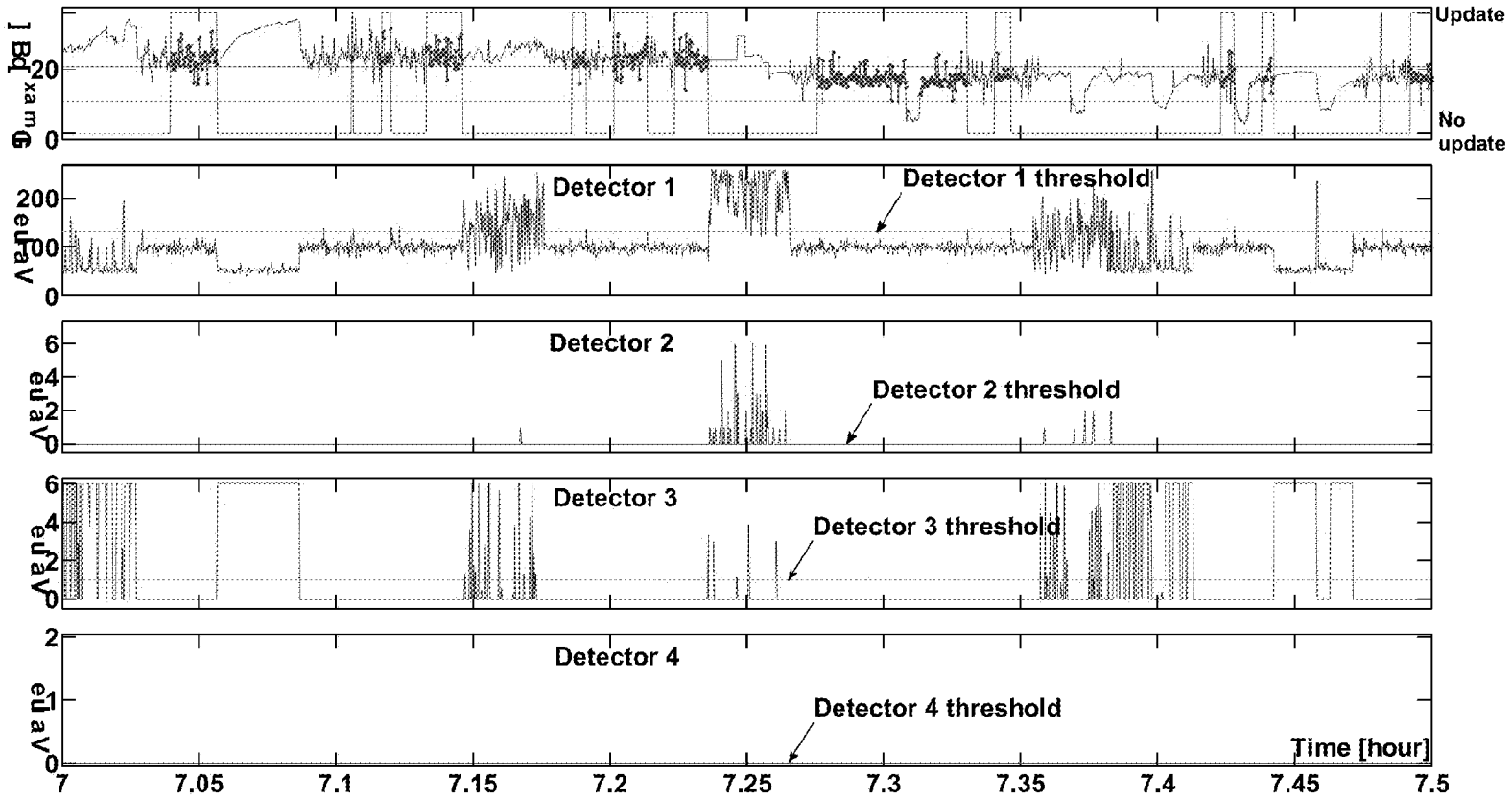
FIG. 8 shows an example of a feedback estimate signal (IGmax), four detector values versus time and a resulting control signal (UPDATE_ENABLE) based on the four detector signals and indicating whether or not the current feedback estimate is reliable (suitable for use in a long term estimate)

An example of an implementation of the above update equation is shown in FIG. 7. A data example including four different detectors is shown in FIG. 8.

FIG. 7 shows an exemplary flow chart for implementation of a control unit based on an update equation for the long term estimate of IGmax according to the present disclosure. The procedure illustrated in FIG. 7 from Start to End is assumed to be initiated once for every new estimate of current IGmax (IGmax_fast in FIG. 7). The COUNTER(f) is NOT intended to be reset from one activation of the procedure to the next. In other words the purpose of the COUNTER(f) is to ensure that the detector criteria are fulfilled for a number (e.g. 20 or 40) of consecutive estimates of current IGmax. Hence, when Reset COUNTER(t) is performed, COUNTER(f) is set to the number of samples (max_count(t)) of current IGmax for which the criterion must be fulfilled to qualify to be a reliable current IGmax-value.

The method is initiated by increasing frequency f (i.e. choosing the first (next) frequency where a criterion of a detector is intended to be evaluated). The next step evaluates the criterion for each detector (e.g. $DET_i(f)<DET_i_THR(f)$, i=1, 2, . . . , ND, where ND is the number of detectors, here ND is four) at the chosen frequency f. If all detectors fulfil their respective criteria, the COUNTER(f) is decreased (from a maximum value max_count(f)), otherwise the COUNTER(f) is reset (to the maximum value max_count(f), from which it is decreased). After a decrease of the COUNTER(f), it is checked whether COUNTER(f)==0. If this is the case (as a sign that the detector criteria have been fulfilled (at a given frequency) for a time corresponding to max_count(f) samples of IGmax_fast), the IGmax slow(t)−IGmax_fast(t)<IGmax_offset(t)? condition is evaluated. Its fulfilment indicates that the current IGmax estimate is within a predetermined range of the long term IGmax estimate. If this condition is met, all conditions indicating a reliable current feedback path estimate are fulfilled at the frequency in question. The current feedback (or IGmax) estimate can be stored as a reliable value and used in an update of the long term feedback path or IGmax estimate at the frequency in question (as here indicated by action Update IGmax_slow(t) assuming an update of an algorithm for determining IGmax_slow based on current (and possibly previous) reliable IGmax_fast-values), e.g. by filtering or by counting long term IGmax values up or down with a predefined step size, as exemplified above. The step size may e.g. depend on the ratio of total time to valid update time. The 'total time' is the 'on time' of the listening device (e.g. since its last power-on) and the 'valid update time' is the part of total time in which a valid estimate of the feedback path (or IGmax) has been available (see e.g. FIG. 8, top graph, where the 'valid update time' is the part of the time, where the parameter UPDATE_ENABLE is 'high' (equal to 'Update')).

Correspondingly, if the condition IGmax_slow(f)−IGmax_fast(f)<IGmax_offset(f) is NOT fulfilled (as a sign that the current feedback path estimate deviates substantially from the long term estimate), the condition f==FMAX? is evaluated.

If the frequency is equal to FMAX, all relevant frequencies have been checked and the procedure ends (for the current IGmax_fast sample). Otherwise, the frequency is increased and the detector criteria checked, etc.

If the criterion for each detector ($DET_i(f)<DET_i_THR(f)$, i=1, 2, . . . , ND, is NOT fulfilled for all detectors for a given frequency, the COUNTER(f) is reset to the maximum value max_count(f) at the frequency in question and the criterion f==FMAX? is evaluated. If f=FMAX, the procedure is terminated (for the current IGmax_fast sample). If the criterion f==FMAX? Is NOT fulfilled the frequency is increased and the detector criteria are evaluated as described above.

If the COUNTER(f)==0?-condition is NOT fulfilled at a given frequency (as a sign that the detector criteria have NOT yet been fulfilled for a time corresponding to max_count(f)), the criterion f==FMAX? is evaluated. If the current frequency is NOT the maximum frequency intended for evaluation of the detector criteria, the frequency is increased to the next value and the detector criteria are evaluated as described above. If, on the other hand, the current frequency is equal to the maximum frequency, the evaluation procedure has been completed (for the current IGmax_fast sample).

FIG. 8 shows an example of the time dependence of a feedback estimate signal (here IGmax, top graph), four detector values and a resulting control signal (UPDATE_ENABLE, binary signal 'Update'/'No update' on the top graph) based on the four detector signals and indicating whether or not the current feedback estimate is reliable (suitable for use in a long term estimate). The example is generated for a single frequency channel (the center frequency is 2031 Hz) and the time period spanned by the graphs corresponds to 0.5 hour. The top subfigure shows the fast IGmax estimate (solid curve) from the DFC system (see e.g. FIG. 3*a* or 9), the time instances (dots) where updates of the long term IGmax estimate can be carried out according to the UPDATE_ENABLE variable, and the long term IGmax estimate (horizontal line denoted IGmax_slow). The detector outputs are shown in the four middle subfigures and the Boolean UPDATE_ENABLE variable is shown in the top subfigure. The control signal UPDATE_ENABLE results from the criterion that all four detector values must be below their respective threshold values for the control signal to be TRUE (here equal to one, denoted Update in the right vertical scale of the top subfigure) and otherwise it is FALSE (here equal to zero, correspondingly denoted No update). The detectors may comprise any detector indicating a property of the acoustic environment of the listening device and/or of the signal currently being processed in the listening device. Examples of such detectors are: Autocorrelation of a signal of the forward path, cross-correlation between an input and an output signal of the forward path, loop gain, rate of change of loop gain, rate of change of feedback path, tone/music detector, reverberation, mode of operation of the listening device (e.g. various directionality modes, e.g. OMNI or DIR mode), type of signal (speech/noise/silence), modulation, input level, etc. The lower subfigure (relating to Detector 4) may e.g. represent a 'mode detector', e.g. related to directionality, the listening device being in the same mode (e.g. omni-directional mode) during the time considered.

Figure 9:
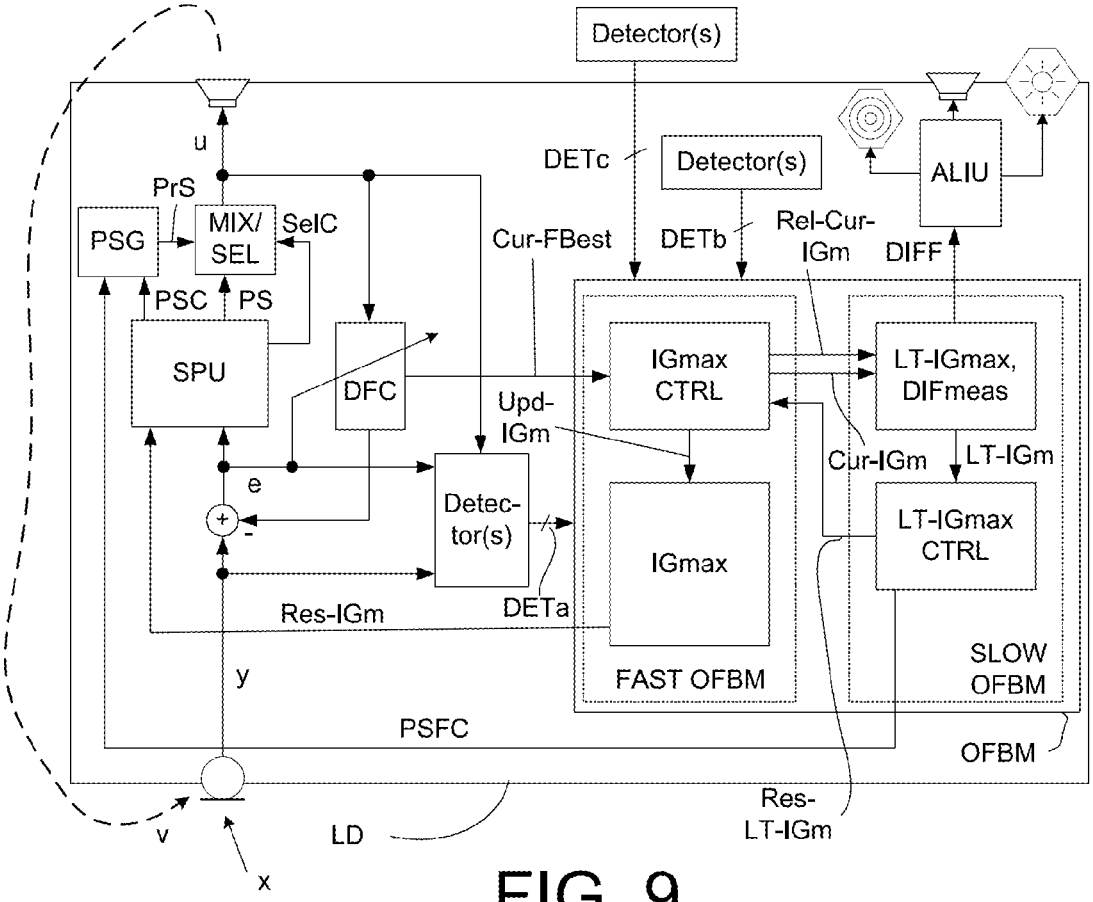
FIG. 9 shows an embodiment of a listening device according to the present disclosure.

FIG. 9 shows an embodiment of a listening device (LD) according to the present disclosure. The listening device comprises a forward path between a microphone for converting an input sound to an electric input signal y and a loudspeaker for converting a processed electric signal u to an output sound, the forward path comprising a signal processing unit SPU for processing an input signal e and providing a processed output signal PS. The listening device further comprises a probe signal generator PSG for generating a probe signal PrS adapted to be used in an estimation of the feedback path (signal v) from the speaker to the microphone. The activation and control of the probe signal generator PSG is performed by the signal processing unit SPU via signal PSC (or alternatively or additionally via a user interface, cf. e.g. FIG. 1*f*). The forward path further comprises a mixer/selector unit MIX/SEL for mixing or selecting between inputs PrS (probe signal) and PS (processed signal from the signal processing unit). The mixer/selector unit MIX/SEL is controlled by the signal processing unit SPU via signal SelC (or alternatively or additionally via a user interface). The listening device further comprises an adaptive feedback estimation unit DFC for dynamically estimating a feedback path from the loudspeaker to the microphone. The adaptive feedback estimation unit DFC provides an estimate signal $\hat{v}$ of the current feedback path, which is subtracted from the electric input signal y (comprising feedback signal v and additional ('target') signal x) from the microphone in combination unit+providing a feedback corrected error signal e, which is fed to the signal processing unit SPU and used in the feedback estimation unit DFC together with the output signal u to estimate the current feedback path. The listening device may preferably comprise more than one microphone and possibly more than one feedback estimation block (cf. e.g. FIG. 1*e*). Additionally, the listening device comprises an online feedback manager (OFBM) and a number of detectors (Detector(s)). The detectors monitor parameters or properties of the acoustic environment of the listening device and/or of a signal of the listening device, each detector providing one or more detector signals (DETa, DETb, DETc). The detector signals (DETa, DETb, DETc) are fed to the online feedback manager (OFBM) for evaluation. The detectors are e.g. adapted to monitor various parameters or properties (e.g. autocorrelation, cross-correlation, loop gain), of the signal of the forward path (cf. Detector(s) generating detector signal DETa) and/or of the acoustic environment and/or of the current mode of operation of the listening device. The detectors may be (physically) internal or external to the listening device. A detector signal (e.g. DETc in FIG. 10) may be received from an external sensor, e.g. wirelessly received using a wireless receiver unit in the listening device. The online feedback manager (OFBM) comprises a fast and a slow online feedback manager (FAST OFBM and SLOW OFBM, respectively). The FAST OFBM comprises a control unit (IGmax CTRL) for—based on signals from the detectors—extracting a reliable current IGmax value (output signal Rel-Cur-IGm) from a (current or instant) feedback path estimate (signal Cur-FBest) from the DFC system (DFC) (cf. also FIG. 5), which is fed to the SLOW OFBM. The control unit (IGmax CTRL) further determines a current IGmax value (e.g. based on the current or instant feedback path estimate (signal Cur-FBest) received from the DFC) representing the current acoustic situation of the listening device (be it reliable/representative or not), i.e. without having been 'filtered' by a reliability criterion based on signals from the detectors. These current ('unfiltered') IGmax values are also fed to the SLOW OFBM (output signal Cur-IGm). The FAST OFBM further comprises a unit (IGmax) for storing (updated) values of (current, reliable) IGmax values (cf. signal Upd-IGm) at different frequencies received from the control unit (IGmax CTRL). The signal processing unit SPU relies on the IGmax values of the IGmax unit of the FAST OFBM (cf. signal Res-IGm) in the determination (limitation) of the gain of the forward path in a given acoustic situation. The SLOW OFBM comprises a calculation unit (LT-IGmax, D/Fmeas) for determining a reliable long term IGmax value (for each frequency considered) from the reliable current IGmax values (signal Rel-Cur-/Gm), e.g. by a smoothing procedure, e.g. as a moving average (or a weighted average as e.g. provided by IIR filtering) of reliable current IGmax values stored over a predefined time (e.g. days) or according to a predefined algorithm. The listening device is e.g. adapted to relate the smoothing time to the leakage growth rate, either by a predefined estimated growth rate or an adaptively determined growth rate (e.g. based on the rate of change of a feedback path estimate or IGmax estimate). The calculation unit is adapted to determine a feedback or (as here) IGmax difference measure (signal DIFF) based on a difference between the reliable long term IGmax values and the instant or current IGmax values (signal Cur-IGm). The listening device further comprises an alarm indication unit (AL/U) adapted to issue an alarm indication (e.g. as an acoustic, a visual indication and/or as a mechanical vibration, as indicated by the corresponding symbols in FIG. 9) based on the feedback or IGmax difference measure or any other criterion, e.g. related to current IGmax being lower than a threshold value IGmax,TH, (signal DIFF) to a user or a caring person. The alarm indication may e.g. be an acoustic sound, a visual indication and/or a mechanical vibration, as indicated by the corresponding symbols in FIG. 9. The loudspeaker used by the alarm unit AL/U providing an acoustic indication may e.g. be the same as the one used in the forward path. The SLOW OFBM further comprises a 'learning unit' LT-IGmax CTRL for—based on input signal LT-IGm representing reliable long term IGmax values—providing such reliable long term IGmax values to the control unit (IGmax CTRL), cf. signal Res-LT-IGm according to a predefined scheme (e.g. with a predefined update frequency or when specific conditions are met, or initiated via a user or programming interface). Thereby reliable (slowly varying) IGmax values may be 'fed back' and used in the signal processing unit controlled by the control unit (IGmax CTRL), e.g. updated with a small update frequency intended to adapt IGmax to the changes of an ear canal due to a child's growth. Further, frequencies where maximum feedback occur and/or frequencies where minimum gain margin occur are forwarded to the probe signal generator PSG for possible use in the probe signal PrS, cf signal PSFC from the 'learning unit' LT-IGmax CTRL.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims.

REFERENCES

[Schaub; 2008] Arthur Schaub, Digital hearing Aids, Thieme Medical. Pub., 2008.

[Haykin] S. Haykin, Adaptive filter theory (Fourth Edition), Prentice Hall, 2001.

[Engebretson, 1993] A. Engebretson, M. French-St. George, "Properties of an adaptive feedback equalization algorithm", J Rehabil Res Dev, 30(1), pp. 8-16, 1993

WO 03/081947 A1 (OTICON)

U.S. Pat. No. 5,144,675 (ETYMOTIC)

WO 91/03042 A1 (OTWIDAN)

US 2007/009122 A1 (SAT)

WO 2004/077090 A1 (OTICON)

U.S. Pat. No. 5,473,701 (AT&T)

WO 99/09786 A1 (PHONAK)

EP 2 088 802 A1 (OTICON)

WO 2008/151970 A1 (OTICON)

US 2009/028367 A1 (WIDEX)

The invention claimed is:

1. A method of providing a long term feedback path estimate of a listening device, the listening device comprising a forward path between an input transducer for converting an input sound to an electric input signal and an output transducer for converting an electric output signal to a stimulus perceived by the user as an output sound, the forward path comprising a signal processing unit for applying a frequency dependent gain to the electric input signal or a signal originating therefrom and for providing a processed signal, and feeding the processed signal or a signal originating therefrom to the output transducer;

an analysis path for analysing a signal of the forward path and comprising a feedback estimation unit for adaptively estimating a feedback path from the output transducer to the input transducer, the method comprising:

a) providing an estimate of the current feedback path;

b) providing a number ND of detectors of parameters or properties of the acoustic environment of the listening device and/or of a signal of the listening device, each detector providing one or more detector signals;

c) providing a criterion for deciding whether an estimate of the current feedback path or an equivalent maximum allowable insertion gain IGmax used by the signal processing unit of the forward path derived therefrom is reliable based on said detector signals;

d) using said estimate of the current feedback path or IGmax, if said criterion is fulfilled and neglecting said estimate of the current feedback path or IGmax, if said criterion is not fulfilled; and e) providing a long term estimate of the feedback path or IGmax based on said estimate(s) of the reliable current feedback path or IGmax.

2. A method according to claim 1 comprising comparing the long term feedback path or IGmax estimate with the reliable current feedback path or IGmax estimate, and providing a measure for their difference, the feedback or IGmax difference measure.

3. A method according to claim 1 wherein said criterion for deciding whether an estimate of the current feedback path or IGmax is reliable is defined by a quality parameter.

4. A method according to claim 1 wherein said criterion comprises a sub-criterion for each of said detectors.

5. A method according to claim 1 wherein said estimate of the current feedback path or IGmax is only stored if said criterion for deciding whether an estimate of the current feedback path is reliable is fulfilled for a predetermined time $\Delta T_{crit}$, wherein said predetermined time $\Delta T_{crit}$ is in the range from 0 s to 10 s.

6. A method according to claim 2 wherein values of reliable current feedback path or IGmax estimates that are used in the long term estimate of the feedback path or IGmax are controlled by the feedback or IGmax difference measure, respectively.

7. A method according to claim 1, wherein

IGmax(f) is a frequency dependent maximum insertion gain value that may be applied to an input signal and frequency dependent threshold values IGmax,TH(f) of IGmax(f) define a warning criterion for issuing a warning and/or initiating an action, when a current value of IGmax(f) at a time t and frequency f, IGmax(f,t) value is below said threshold value IGmax,TH(f).

8. A method according to claim 7 wherein a warning signal is generated when said warning criterion is fulfilled.

9. A method according to claim 7 wherein IGmax, which is used in the listening device to limit gain of the forward path, is reduced when said warning criterion is fulfilled.

10. A method according to claim 1 wherein the long term estimate of the feedback path or IGmax is determined by an update algorithm comprising a time constant $t_c$ that determines the maximum rate of change of the long term estimate.

11. A method according to claim 10, wherein the time constant $t_c$, together with a sample rate $f_s$, determine a step size $\mu$ needed to get a particular rate of change of the long term estimate, and wherein the time constant $t_c$ is adapted to be proportional to a rate of change of leakage from the output transducer to the input transducer.

12. A method according to claim 1, wherein

FBG(t) is an estimate of an external feedback path from the output transducer to the input transducer at time t and FBGmax(t,f) is a maximum predictable feedback gain value at time t and frequency f, the long term estimate of FBG(t), FBGmax,slow, or the long term estimate of IGmax, IGmax,slow, is determined from reliable current estimates, FBG(t) or IGmax(t), respectively, FBGmax,slow(t,f)=$\alpha$FBGmax(t,f)+(1−$\alpha$) FBGmax, slow(t−1,f), or IGmax,slow(t,f)=$\alpha$IGmax(t,f)+(1−$\alpha$) IGmax,slow(t−1,f), respectively, where $\alpha$ is a parameter between 0 and 1, t is time and f is frequency and 't−1' indicates the previous time instance, for which a reliable value of FBGmax,slow or IGmax, slow, respectively, is available.

13. A method according to claim 12 wherein the parameter $\alpha$ is adaptively determined.

14. A method of implementing an automatic procedure for adapting long term maximum insertion gain, IGmax, values at a given frequency to a change of mould, the method comprising:

a) identifying that reliable IGmax,fast>>IGmax,slow;

b) increasing an update rate of an algorithm for determining long term estimates IGmax,slow from current reliable estimates IGmax,fast; and c) decreasing the update rate, when reliable IGmax, fast~IGmax,slow, wherein IGmax,fast is a reliable current value of the maximum insertion gain IGmax, IGmax,slow is a long term estimate of the maximum insertion gain IGmax, and $\alpha$ is a value between 0 and 1 determining an adaption or update rate.

15. A method for implementing an automatic procedure for adapting long term maximum insertion gain, IGmax, values at a given frequency to a substantial growth of the ear canal, the method comprising:

a) identifying that reliable IGmax,fast<<IGmax,slow;

b) increasing an update rate of an algorithm for determining long term estimates IGmax,slow from current reliable estimates IGmax,fast; and c) decreasing the update rate, when reliable IGmax, fast~IGmax,slow, wherein IGmax,fast is a reliable current value of the maximum insertion gain IGmax, IGmax,slow is a long term estimate of the maximum insertion gain IGmax, and $\alpha$ is a value between 0 and 1 determining an adaption or update rate.

16. A listening device comprising a forward path between an input transducer for converting an input sound to an electric input signal and a loudspeaker for converting an electric output signal to an output sound, the forward path comprising a signal processing unit for applying a frequency dependent gain to the electric input signal or a signal originating therefrom and for providing a processed signal, and feeding the processed signal or a signal originating therefrom to the loudspeaker;

an analysis path for analysing a signal of the forward path and comprising a feedback estimation unit for adaptively estimating a feedback path from the loudspeaker to the input transducer, wherein a) a fast feedback estimation unit for providing an estimate of the current feedback path;

b) a number ND of detectors of parameters or properties of the acoustic environment of the listening device and/or of a signal of the listening device, each detector providing one or more detector signals;

c) a control unit for deciding whether an estimate of the current feedback path or an equivalent maximum allowable insertion gain IGmax applied by the signal processing unit of the forward path derived therefrom is reliable based on said detector signals and a predefined criterion;

d) a memory for storing said estimate of the current feedback path or IGmax, if said criterion IS fulfilled and neglecting said estimate of the current feedback path or IGmax, if said criterion is NOT fulfilled;

e) a calculation unit for providing a long term estimate of the feedback path or IGmax based on said stored estimate(s) of the reliable current feedback path or IGmax.

17. A listening device according to claim 16 comprising an alarm indication unit adapted for issuing an alarm signal based on one of said difference measures.

18. A listening device according to claim 16 wherein the number ND of detectors at least comprises a correlation detector or a tone detector or a howl detector.

19. A data processing system comprising a processor and program code means for causing the processor to perform the steps of the method of claim 1.

20. A listening system, comprising a listening device according to claim 16 and an auxiliary device, wherein the system is adapted to establish a communication link between the listening device and the auxiliary device to provide that information can be exchanged or forwarded from one to the other, wherein the auxiliary device comprises a remote control, an audio gateway, a smart phone, or a baby alarm, and is adapted for receiving an alarm signal from the listening device and comprises a visual indicator for visualizing an associated message allowing a user and/or a caring person to receive an information about a status of a fitting of an ear mould.

21. A listening device according to claim 16 comprising a hearing aid, a headset, an earphone, an ear protection device or a combination thereof.

* * * * *